US006975298B2

(12) United States Patent
Koyama et al.

(10) Patent No.: US 6,975,298 B2
(45) Date of Patent: Dec. 13, 2005

(54) ACTIVE MATRIX DISPLAY DEVICE AND DRIVING METHOD OF THE SAME

(75) Inventors: Jun Koyama, Kanagawa (JP); Buyeol Lee, Nara (JP); Yasuhiro Hirayama, Osaka (JP); Yasushi Kubota, Nara (JP)

(73) Assignees: Semiconductor Energy Laboratory Co., Ltd., (JP); Sharp Kabushiki Kaisha, (JP)

( * ) Notice: Subject to any disclaimer, the term of this patent is extended or adjusted under 35 U.S.C. 154(b) by 0 days.

(21) Appl. No.: 10/816,048

(22) Filed: Apr. 1, 2004

(65) Prior Publication Data

US 2004/0196235 A1 Oct. 7, 2004

(30) Foreign Application Priority Data

Apr. 4, 2003 (JP) ..... 2003-101009

(51) Int. Cl.[7] ..... G09G 3/36
(52) U.S. Cl. ..... 345/98; 345/90
(58) Field of Search ..... 345/87, 89, 91, 345/90, 92, 93, 98, 103

(56) References Cited

U.S. PATENT DOCUMENTS 4,870,396 A * 9/1989 Shields ..... 345/90
5,798,746 A 8/1998 Koyama ..... 345/98
6,225,991 B1 * 5/2001 McKnight ..... 345/205
6,542,139 B1 * 4/2003 Kanno ..... 345/87
6,614,415 B2 * 9/2003 Mizutani et al. ..... 345/90
2002/0024485 A1 2/2002 Koyama ..... 345/87

FOREIGN PATENT DOCUMENTS

JP 07-199157 8/1995
JP 2002-287708 10/2002

* cited by examiner

*Primary Examiner*—Dennis-Doon Chow
(74) *Attorney, Agent, or Firm*—Cook, Alex, McFarron, Manzo, Cummings & Mehler, Ltd.

(57) ABSTRACT

An AC driven active matrix display device in which image display with enough brightness can be easily achieved while reducing an amplitude range of a pixel electrode potential. The display device 1, 100 or 110 according to the invention comprises two memory circuits (a first memory circuit 40 and a second memory circuit 41) which are connected in series between each pixel electrode 22 and a corresponding signal line 30. Data is written to the first memory circuit in a first period, then the data is transferred from the first memory circuit to the corresponding second memory circuit in a second period. The potential of a counter electrode 23 is switched in the second period between a first potential (VcomH) and a second potential (VcomL).

39 Claims, 13 Drawing Sheets

ACTIVE MATRIX DISPLAY DEVICE AND DRIVING METHOD OF THE SAME

BACKGROUND OF THE INVENTION

1. Field of the Invention

The present invention relates to an active matrix display device and more particularly relates to an active matrix liquid crystal display device using digital gray scale. In addition, the invention relates to electronic equipment comprising such a display device.

2. Description of the Related Art

In recent years, as a flat panel display (FPD), an active matrix semiconductor display device leads the market. Above all, an active matrix liquid crystal display device in which liquid crystal is used for display medium (also known as electro-optic modulating layer) is widely used as a display device of electronic equipment such as a personal computer. In the active matrix liquid crystal display device, either analog gray scale in which the brightness of each pixel is continuously changed or digital gray scale in which the brightness of each pixel is discretely changed is used. Analog gray scale is realized, for example, by continuously changing a voltage applied to a liquid crystal cell allocated to each pixel and by continuously changing the light transmissivity of the liquid crystal cell. Area gray scale and time gray scale are included in digital gray scale. In area gray scale, a plurality of liquid crystal cells are allocated to each pixel and the brightness of each pixel is changed in accordance with a combination of liquid crystal cells which transmit light. Meanwhile, in time gray scale, a single liquid crystal cell is allocated to each pixel and the brightness of each pixel is changed by discretely changing light transmitting time of the liquid crystal cell in one frame. In addition, a color display is widely provided by using red (R), green (G) or blue (B) filter for each pixel.

FIG. 13 is a circuit diagram which shows a frame format of a conventional active matrix liquid crystal display device. As shown in FIG. 13, an active matrix liquid crystal display device 200 comprises a pixel matrix portion (also referred to as a liquid crystal display portion) 210, a signal line driver circuit 211, and a scan line driver circuit 212. In recent years, the pixel matrix portion 210, the signal line driver circuit 211, and the scan line driver circuit 212 of the active matrix liquid crystal display device 200 are formed on the same substrate by using low temperature poly-silicon thin film transistors (TFTs). Since such low temperature poly-silicon liquid crystal display device 200 can be easily reduced in size, it is particularly suitable for medium or small sized display panel of portable electronic equipment and the like. Furthermore, as the characteristics of low temperature poly-silicon TFTs are enhanced recently, circuits operated with a low voltage (for example 5V) in the liquid crystal display device 200, such as a CPU 213, a controller 214, a memory (not shown) can be made up of low temperature poly-silicon TFTs as well as the pixel matrix portion 210 and the driver circuits 211 and 212. When low temperature poly-silicon TFTs are used for these low-voltage circuits, it is desirable to shorten the gate length in order to improve frequency characteristics and increase element density. However, in the case of shortening the gate length, short channel effect easily occurs, and the characteristics of TFTs vary easily by the drain voltage. Therefore, it is necessary for instance to make a gate insulating layer as thin as possible in order to suppress the short channel effect. For example, it is preferable that a TFT of 5 V has a gate of 2 $\mu$m or less in length and a gate insulating layer of 50 nm or less in thickness.

In the pixel matrix portion 210, a signal line 230 and a scan line 231 are arranged in matrix, and a pixel TFT 242 is disposed at an intersection of the signal line 230 and the scan line 231. For the pixel TFT 242, a field effect transistor (FET) is used in general. The gate, source and drain of each TFT 242 are connected to the corresponding scan line 231, the signal line 230 and a pixel electrode 222, respectively. It is to be noted that the signal line 230 and the scan line 231 are respectively connected to the source and gate of the corresponding TFT 242, thus they may be referred to as a source signal line and a gate signal line, respectively.

A counter electrode 223 is arranged so as to face a plurality of pixel electrodes 222, and a liquid crystal 224 is arranged between the pixel electrodes 222 and the counter electrode 223. In other words, a liquid crystal cell 221 is composed of the pixel electrode 222, the counter electrode 223 and the liquid crystal 224. It is to be noted that although separate liquid crystals 224 seem to be provided in each pixel electrode 222 in FIG. 13, the liquid crystal 224 is ordinarily used as a single member which extends across a plurality of pixel electrodes 222, as well known to those skilled in the art. The same is equally true for the counter electrode 223.

In general, the liquid crystal cell 221 which is composed of the pixel electrode 222, the counter electrode 223, and the liquid crystal 224 interposed therebetween cannot have large electrostatic capacity. Therefore, a storage capacitor 225 is provided in the vicinity of the pixel electrode 222 in order to store electric charge. Although not shown, the TFT 242 and the pixel electrode 222 in the pixel matrix portion 210, and the driver circuits 211 and 212 are ordinarily provided on the same substrate (also referred to as an active matrix substrate or an element substrate). On the other hand, the counter electrode 223 is provided on another substrate (also referred to as a counter substrate). The liquid crystal 224 is interposed between the two substrates.

When a potential (a selective signal) is applied to the scan line 231 so that a voltage between the gate and source of the TFT 242 exceeds the threshold voltage, the TFT 242 is turned on. Then, the drain and source of the TFT 242 are short circuited. The potential applied to the signal line 230 is transmitted to the pixel electrode 222, and the liquid crystal cell 221 and the storage capacitor 225 are charged in accordance with that potential. When the TFT 242 is turned off, there is no conductivity between the drain and source of the TFT 242. The electric charge stored in the liquid crystal cell 221 and the storage capacitor 225 is held until the TFT 242 is turned on. Light transmissivity of the liquid crystal 224 varies depending on whether a voltage is applied or not. Therefore, the brightness of each liquid crystal cell 221 can vary by controlling a potential Vpix of the pixel electrode 222 and a potential Vcom of the counter electrode 223.

When area gray scale is used in the liquid crystal display device 200, for example two adjacent liquid crystal cells 221 are allocated to one pixel. In such a case, the brightness of the pixel can vary with four levels in accordance with a combination of on/off of the two liquid crystal cells 221 (4-level gray scale). When the number of liquid crystal cells 221 to be allocated to each pixel is increased, the brightness of each pixel can vary with multi-level gray scale. The liquid crystal cells 221 having different areas may be allocated to each pixel. Generally and preferably, when k liquid crystal cells $E_1, E_2, \ldots, E_k$ are allocated to one pixel (that is, the number of indicator bits is k), the areas of each liquid crystal cell $E_1, E_2, \ldots, E_k$ are designed so as to be $E_1=1\times E_0$, $E_2=2\times E_0, \ldots, E_k=2^{(k-1)}\times E_0$, when the smallest area of the liquid crystal cell is set as $E_0$. By changing the combination of these areas, the brightness of the pixel can vary with $2^k$-level gray scale as the brightness corresponding to $E_0$ is the smallest unit. In addition, when one liquid crystal cell 221 is allocated to each pixel, digital gray scale can also be used by discretely changing light transmitting time of the liquid crystal cell 221 in one frame of video signal (time gray scale). In this case, k light transmitting time lengths $T_1$, $T_2, \ldots, T_k$ (the total of $T_1$ to $T_k$ is less than one frame period) are designed so as to be $T_1=1\times T_0$, $T_2=2\times T_0$, . . . , $T_k=2^{(k-1)}\times T_0$, when the shortest transmitting time length is set as $T_0$. By changing the combination of these lengths, the brightness of the pixel can vary with $2^k$-level gray scale as the brightness corresponding to $T_0$ is the smallest unit. It is to be noted that in the case of using time gray scale, one frame period is divided into a plurality of subframe periods (pairs of scan period and fly-back period) in order to scan for selecting light transmitting state or non-light transmitting state of the liquid crystal cell in each light emitting time.

In general, the liquid crystal 224 has hysteresis with respect to an applied voltage. Therefore, when a direct current voltage is applied to the liquid crystal 224 for a long period, deterioration such as image persistence is caused. To prevent such image persistence, an electric field in a reverse direction is applied to the liquid crystal 224 at every predetermined period so that the average of voltages applied to the liquid crystal 224 is zero. This driving method is called the inversion drive. In order to perform the inversion drive, as shown in FIG. 14, the potential Vcom of the counter electrode 223 is kept stable, and the polarity of the potential Vpix applied to the pixel electrode 222 (that is, signal line potential) is reversed at every predetermined period (per frame period, for example) based on the potential Vcom of the counter electrode 223. For instance, when the potential Vcom of the counter electrode 223 is 8 V and the potential Vpix of the pixel electrode 222 oscillates between 3 and 13 V, a voltage applied to the liquid crystal 224 is switched between +5 and −5 V. It is to be noted that such inversion drive can be applied to other display medium having hysteresis with respect to an applied voltage as well as the liquid crystal.

In such a driving method, however, amplitude range of a signal line potential is twice as large as a voltage (absolute value) applied to the liquid crystal 224. Therefore, it is required to increase withstand voltage of the signal line driver circuit 211. Further, the gate potential of each TFT 242 varies depending on the source potential. Accordingly, as amplitude range of the signal line potential applied to the source is increased, amplitude range of the gate potential is also increased (for example, from 0 to 16 V). It is thus necessary to increase withstand voltage of the scan line driver circuit 212 to which the gate is connected. For instance, TFTs used for these driver circuits 211 and 212 have preferably a gate of 5 $\mu$m or more in length and a gate insulating layer of 100 nm or more in thickness. Moreover, an LDD structure or a gate overlap LDD structure (GOLD structure) is required, hence the manufacturing cost is increased.

As described above, low-voltage TFTs used for the CPU 213 and the controller 214 have desirably a gate of 2 $\mu$m or less in length and a gate insulating layer of 50 nm or less in thickness. However, when using the driving method shown in FIG. 14, such TFTs cannot be used for the driver circuits 211 and 212. Accordingly, it is necessary to fabricate two types of TFTs: high-voltage TFTs used for the driver circuits 211 and 212, and low-voltage TFTs used for the CPU 213 and the controller 214. Different processes are required for fabricating these TFTs, thus manufacturing processes and costs are increased.

Another driving method is described with reference to FIG. 15. The potential Vcom of the counter electrode 223 is switched between a high level common potential VcomH and a low level common potential VcomL per frame period, for example. Then, the signal line potential Vpix applied to the pixel electrode 222 varies depending on the potential Vcom of the counter electrode 223 (called AC drive). By using this driving method, amplitude range of the potential Vpix of the pixel electrode 222 (signal line potential) can be reduced by half (that is, the same as a voltage applied to the liquid crystal 224) as compared with using the inversion drive shown in FIG. 13. Hence, withstand voltage of the scan line driver circuit 212 can be reduced as well as that of the signal line driver circuit 211. Accordingly, withstand voltage of TFTs used for these driver circuits 211 and 212 can also be reduced, which results in a reduction in the manufacturing cost. In such AC drive, distortion of the image caused by switching the potential Vcom of the counter electrode 223 is necessarily reduced as much as possible. In view of the foregoing, it is suggested that the potential Vcom of the counter electrode 223 is switched and scanned (a potential of the pixel electrode 221 is set for all the pixels) during a period in which a light source such as a back light is turned off (Patent Document 1). This driving method allows to reduce withstand voltage of the driver circuits 211 and 212, but has problems as described below.

For example, in the liquid crystal display device 200, the liquid crystal 224 is switched from a transmissive state to a non-transmissive state when a voltage of 5V is applied. The potential Vcom of the counter electrode 223 and the potential Vpix of the signal line 230 are alternately operated with a voltage of 0 and 5 V (that is, VcomL=0 V and VcomH=5 V in FIG. 15). In such a case, when the potential Vcom of the counter electrode is 0 V in a frame, a voltage of 5 V has to be applied to the liquid crystal 224 in order to obtain a black display in one of the liquid crystal cells 221. Accordingly, the potential Vpix of the corresponding signal line (the potential of the pixel electrode 222) has to be at 5 V. As a result, a voltage of 5 V is charged across the corresponding storage capacitor 225. The potential Vcom of the counter electrode 223 is switched to 5 V in the next frame. However, when data of the liquid crystal cell 221 (voltage across the storage capacitor 225) has not been rewritten yet, electric charge stored in the storage capacitor 225 (or voltage across the storage capacitor 225) is stored. Therefore, the voltage across the storage capacitor 225 is added to the potential Vcom of the counter electrode 223, then the potential Vpix of the pixel electrode 222 is raised to 10 V. Accordingly, the pixel electrode 222 and elements connected thereto (including the pixel TFT 242) require a withstand voltage of 10 V or more, and the manufacturing cost is thus increased.

Further, since the light source is turned off during scanning and is turned on after scanning, emitting time of the light source is made shorter especially when the number of pixels is increased and it takes much time to scan. Thus, it is difficult to obtain a display with enough brightness.

It is suggested that instead of the storage capacitor, a memory circuit is provided between each pixel TFT and the corresponding pixel electrode, and either a high level power supply potential or a low level power supply potential is directly supplied to the pixel electrode in accordance with data stored in the memory circuit (Patent Document 2).

[Patent Document 1]
Japanese Patent Application Laid-Open No. 2002-287708

[Patent Document 2]
Japanese Patent Application Laid-Open No. H07-199157

SUMMARY OF THE INVENTION

In view of the problems described above, it is the primary object of the invention to provide an AC driven active matrix display device in which the potential amplitude range of a pixel electrode is reduced and a low-voltage circuit element can be used in order to reduce the manufacturing cost.

It is the second object of the invention to provide an AC driven active matrix display device in which a display with enough brightness can be easily obtained while reducing the potential amplitude range of a pixel electrode.

It is the third object of the invention to provide the active matrix display device described above with simple structure and at a low cost.

It is the fourth object of the invention to provide electronic equipment using the active matrix display device described above.

According to the invention, an active matrix display device 1, 100 or 110 which comprises a display medium 24 interposed between a pair of substrates is provided to solve the above-described problems. The active matrix display device comprises a plurality of signal lines 30 and scan lines 31 supported by one of the substrates and intersecting each other, a plurality of pixel electrodes 22 supported by the one of the substrates and arranged in matrix, a counter electrode 23 supported by the other of the substrates and interposing the display medium between the pixel electrodes, and a plurality of pairs of memory circuits provided between each of the pixel electrodes and a corresponding one of the signal lines. Each pair of memory circuits are composed of a first memory circuit 40 connected to the corresponding signal line and a second memory circuit 41 connected to the corresponding pixel electrode. In accordance with a state of the second memory circuit, either of two different potentials (VDD or VSS) is supplied to the corresponding pixel electrode. The active matrix display device according to the invention also comprises a plurality of first switches 42 each connected between the corresponding first memory circuit and the corresponding signal line. The first switches are selectively turned on by a selective signal from the corresponding scan line and enable to write data on the corresponding signal line to the corresponding first memory circuit. The active matrix display device further comprises a plurality of second switches 43 each connected between the corresponding first memory circuit and the corresponding second memory circuit. When the second switches are turned on, data can be transferred from the corresponding first memory circuit to the corresponding second memory circuit. The active matrix display device still further comprises at least one transfer control line 44 for supplying a transfer signal which selectively turns on the second switches, and a transfer control line driver circuit 45 for driving the transfer control line.

According to an embodiment mode of the invention, a plurality of pixel electrodes are allocated to each pixel of the active matrix display device. Signal lines are equal in number to the pixel electrodes included in one horizontal line, and each of the first switches corresponding to the pixel electrodes allocated to each pixel is connected to a corresponding one of the signal lines. Preferably, a signal line driver circuit for driving the signal lines comprises as many latch circuits as the pixel electrodes included in one horizontal line in order to store data corresponding to the pixel electrodes, and each of the signal lines is connected to a corresponding one of the latch circuits.

According to another embodiment mode of the invention, a plurality of pixel electrodes are allocated to each pixel, signal lines equal in number to the pixels included in one horizontal line are provided, a plurality of first switches corresponding to the pixel electrodes allocated to each pixel are connected to a single signal line, and each of the first switches is connected to different scan lines. Preferably, a signal line driver circuit for driving the signal lines comprises a plurality of latch circuits in order to store data corresponding to the pixel electrodes allocated to each pixel included in one horizontal line, and also comprises as many selective switches (SWs) as the signal lines, which are provided between the latch circuits and the signal lines in order to select data to be transferred to the signal lines among data stored in the latch circuits. In such a configuration, the number of signal lines can be reduced as compared with the case of providing as many signal lines as the pixel electrodes included in one horizontal line. Therefore, this configuration is advantageous especially when a plurality of pixel electrodes allocated to each pixel are arranged along the extending direction of the signal lines and an area is limited to the direction perpendicular to the extending direction of the signal lines.

According to the above-described active matrix display device, a pair of memory circuits (a first memory circuit and a second memory circuit) are provided for each pixel electrode. Therefore, in a first period (scan period), image display can be performed by using data transferred from the first memory circuit to the second memory circuit in the preceding second period, while sequentially turning first switches on and writing to the first memory circuit data corresponding to a counter electrode potential set in the subsequent second period (fly-back period). Thus, image display can be performed in the first period without distortion of the image. Accordingly, image display having enough brightness can be easily achieved while reducing distortion of the image due to AC drive and maintaining enough period of image display.

Preferably, the second period is used as a fly-back period of image signals. Further, according to an embodiment mode of the invention, the potential of a counter electrode can be switched per frame period of image signals.

Either of two different potentials (a high level power supply potential VDD or a low level power supply potential VSS) is supplied to each pixel electrode through the corresponding second memory circuit. Therefore, even when the potential of a counter electrode is switched between first and second potentials with AC drive, the potential of the pixel electrode (Vpix) is not influenced by this change. Since the potential of the pixel electrode is not increased undesirably, low-voltage elements (such as TFTs) can be used and manufacturing costs can be reduced.

Especially when one of the two different potentials supplied to the corresponding pixel electrode through the second memory circuit is almost equal to the first potential and the other is almost equal to the second potential, potential difference between the two different potentials (or potential difference between the first potential and the second potential) can be lowered to be equal to an absolute value of a voltage applied to the display medium. It is to be noted that the potential of the counter electrode is desirably switched in the second period, because an image can be displayed without distortion.

Preferably, the first and second switches can be obtained by using thin film transistors, and the first and second memory circuits can be obtained by using an SRAM or a DRAM. In this case, it is preferable that the active matrix display device of the invention comprises a signal line driver circuit for driving signal lines, a scan line driver circuit 12 for driving scan lines, and a logic circuit, and that the signal line driver circuit 11 or 11*a*, the scan line driver circuit, a transfer control line driver circuit, first and second memory circuits, first and second switches, and the logic circuit use the same type of thin film transistors. In such a case, all the thin film transistors used for these circuits and elements can be manufactured by the same process, thus the manufacturing cost can be reduced. The logic circuit may include a CPU 13 or 143, an image processing circuit 145, and a controller which controls timing of the signal line driver circuit, the scan line driver circuit and the transfer control line driver circuit.

In the case of using digital gray scale for the active matrix display device according to the invention, the brightness of each pixel can be changed in stages. Particularly, by allocating a plurality of pixel electrodes to each pixel, area gray scale display device can be achieved. When using area gray scale by allocating k (k is an integer of two or more) pixel electrodes to each pixel, the area ratio between each pixel electrode is set to be $1:2:4 \ldots :2^{k-1}$ on the basis of the minimum pixel electrode area. In this case, the brightness of each pixel can preferably vary with $2^k$-level gray scale as the brightness of the minimum pixel electrode is the smallest unit.

According to an embodiment mode of the invention, a transfer control line is arranged substantially parallel to signal lines. According to another embodiment mode of the invention, a transfer control line may also be arranged substantially perpendicular to signal lines. When the display device comprises a plurality of transfer control lines, these transfer control lines are divided into a plurality of groups, and a transfer signal is supplied to each group with different timing. As a result, rapid transfer of electric charge caused by transferring data from the first memory circuit to the second memory circuit can be prevented, and power supply voltage can be prevented from being changed.

A liquid crystal is typically used for the display medium. The above-described active matrix display device can be applied to various types of electronic equipment 120 such as a mobile phone, a digital camera, a video camera, a PDF, a notebook computer, a wrist watch, a portable DVD player, a projector, and a portable book (electronic book).

According to the invention, a driving method of an active matrix display device 1, 100 or 110 comprising a display medium 24 interposed between a pair of substrates is provided. The active matrix display device comprises, a plurality of signal lines 30 and scan lines 31 supported by one of the substrates and intersecting each other, a plurality of pixel electrodes 22 supported by the one of the substrates and arranged in matrix, a counter electrode 23 supported by the other of the substrates and interposing the display medium between the pixel electrodes, and a plurality of pairs of memory circuits provided between each of the pixel electrodes and a corresponding one of the signal lines. Each pair of memory circuits are composed of a first memory circuit 40 connected to the corresponding signal line and a second memory circuit 41 connected to the corresponding pixel electrode. Either of two different potentials (VDD or VSS) is supplied to the corresponding pixel electrode in accordance with a state of the second memory circuit. The active matrix display device also comprises a plurality of first switches each connected between the corresponding first memory circuit and the corresponding signal line. The first switches 42 are selectively turned on by a selective signal from the corresponding scan line and enable to write data on the corresponding signal line to the corresponding first memory circuit 40. The active matrix display device further comprises a plurality of second switches each connected between the corresponding first memory circuit and the corresponding second memory circuit. When the second switches 43 are turned on, data can be transferred from the first memory circuit to the second memory circuit. The active matrix display device still further comprises at least one transfer control line 44 for supplying a transfer signal which selectively turns on the second switches, and a transfer control line driver circuit 45 for driving the transfer control line. The driving method of the active matrix display device according to the invention comprises the steps of turning the first switches on in a first period to write data to the first memory circuits, then turning the second switches on in a second period to transfer data from each of the first memory circuits to a corresponding one of the second memory circuits, and alternatively switching a counter electrode potential between the first potential and the second potential in the second period.

Preferably, a second period can be used as a fly-back period of image signals. According to an embodiment mode of the invention, the counter electrode potential can be switched per frame period of image signals.

According to this, image display can be performed in a first period (scan period) by using data transferred from the first memory circuit to the second memory circuit in the preceding second period, while sequentially turning the first switches on to write to the first memory circuit data corresponding to a counter electrode potential set in the subsequent second period (fly-back period). Therefore, image display can be performed in the first period without distortion of the image. Thus image display having enough brightness can be easily achieved while reducing distortion of the image due to AC drive and maintaining enough period of image display.

When a plurality of pixel electrodes are allocated to each pixel and each of the pixel electrodes has a corresponding light emitting cell (referred to as a liquid crystal cell when a liquid crystal is used for a display medium), area gray scale can be used in the display device by changing a combination of light emitting cells which transmit light in each pixel. In such a case, signal lines are provided so as to be equal in number to the pixels included in one horizontal line, and a plurality of first switches corresponding to the pixel electrodes allocated to each pixel are connected to a corresponding one of the signal lines. Each of the plurality of first switches corresponding to the plurality of pixel electrodes allocated to each pixel is connected to a different scan line. The driving method by using area gray scale may comprise the step of sequentially outputting data for the pixel electrodes allocated to each pixel from the signal line driver circuit to the corresponding signal line, and the step of turning each of the first switches on by a signal from the corresponding scan line in synchronism with data outputted to the signal line. According to this driving method, it is not necessary to provide as many signal lines as the pixel electrodes included in one horizontal line. Instead, as many as signal lines as the pixels included in one horizontal line are enough, thus the number of signal lines can be reduced and the layout thereof can be simplified.

When the active matrix display device comprises a plurality of transfer control lines and the transfer control lines are divided into a plurality of groups, the driving method of the same preferably comprises the step of supplying a transfer signal to each of the groups with different timing. According to this, rapid transfer of electric charge caused by transferring data from the first memory circuit to the second memory circuit can be prevented, thus power supply voltage can be prevented from being changed.

These and other objects, features and advantages of the invention will become more apparent upon reading of the following detailed description along with the accompanied drawings.

DETAILED DESCRIPTION OF THE INVENTION

[Embodiment Mode]

Explanation will be hereinafter made on embodiment modes of the invention with reference to the accompanied drawings.

Figure 1:
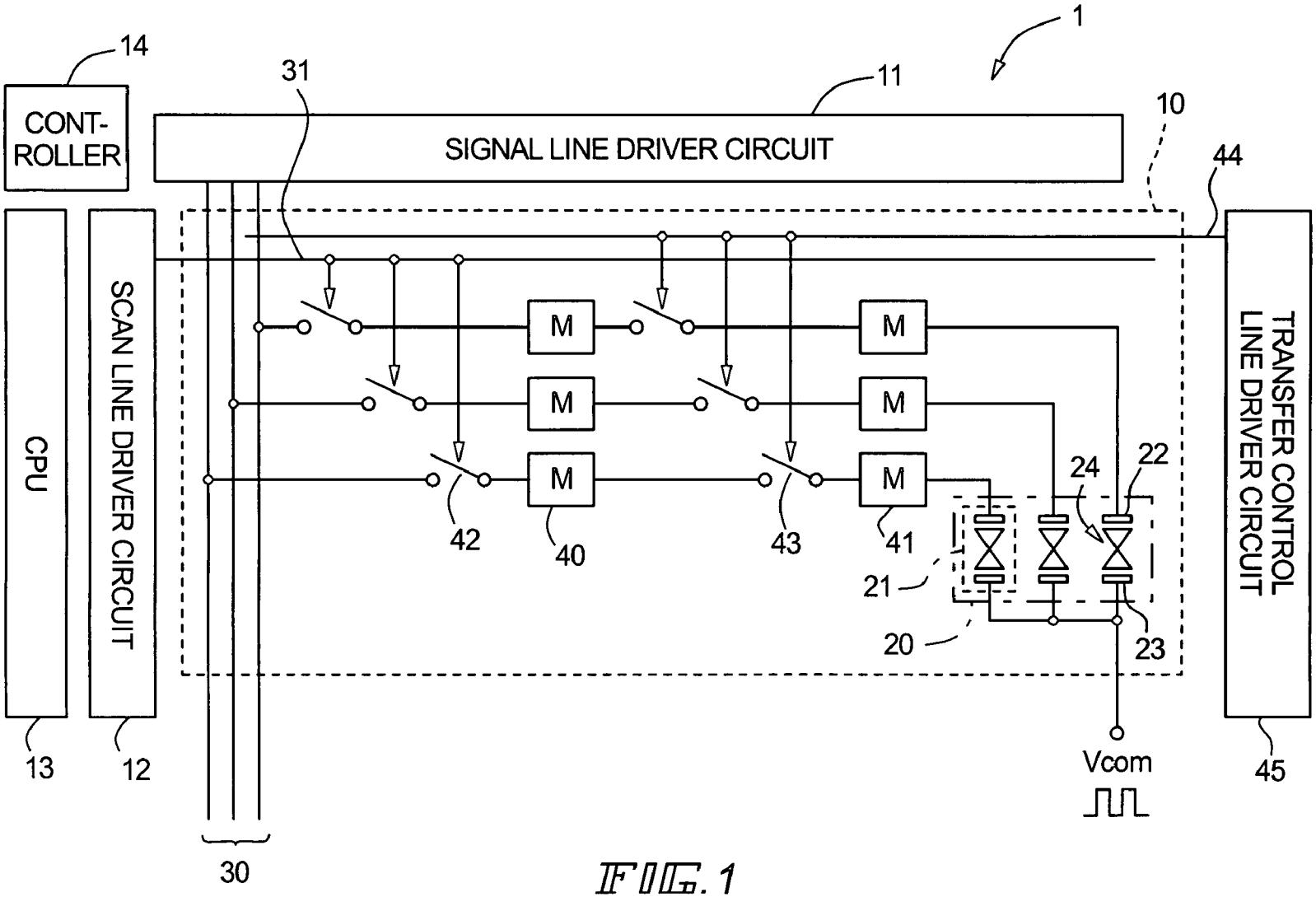
FIG. 1 is a circuit diagram showing a frame format of an active matrix liquid crystal display device according to an embodiment mode of the invention.
Figure 13:
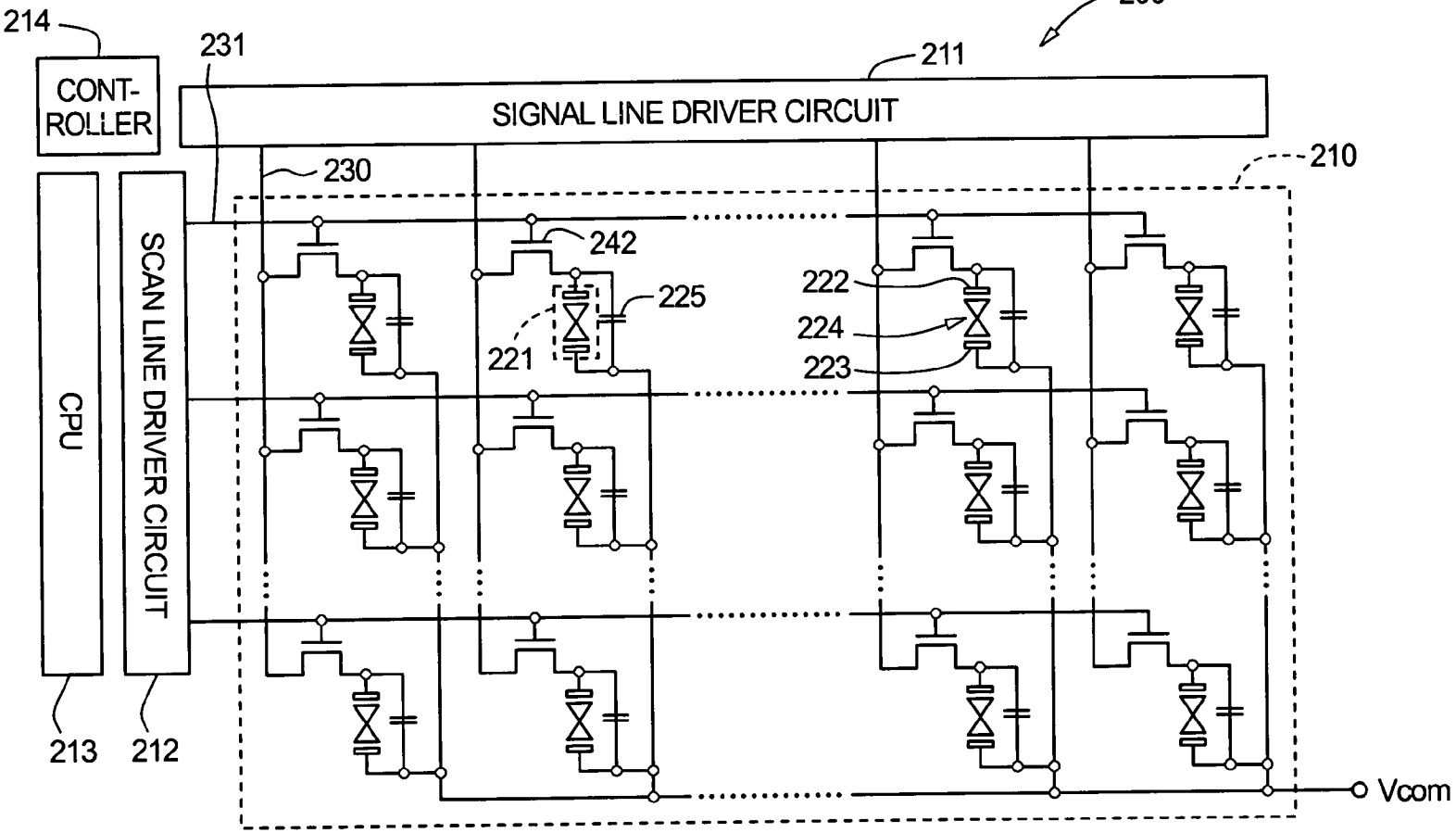
FIG. 13 PRIOR ART
FIG. 13 is a circuit diagram showing a frame format of a conventional active matrix liquid crystal display device.
Figure 14:
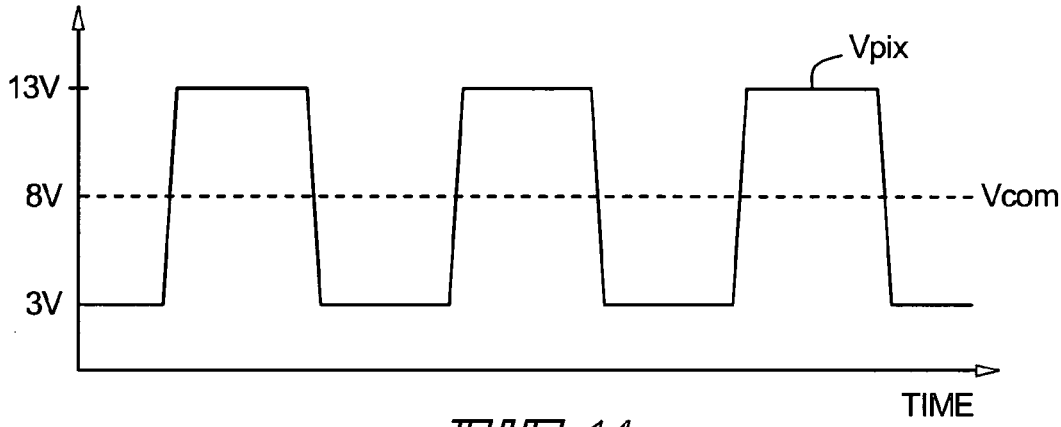
FIG. 14 PRIOR ART
FIG. 14 is a voltage waveform chart for the description of inversion drive.
Figure 15:
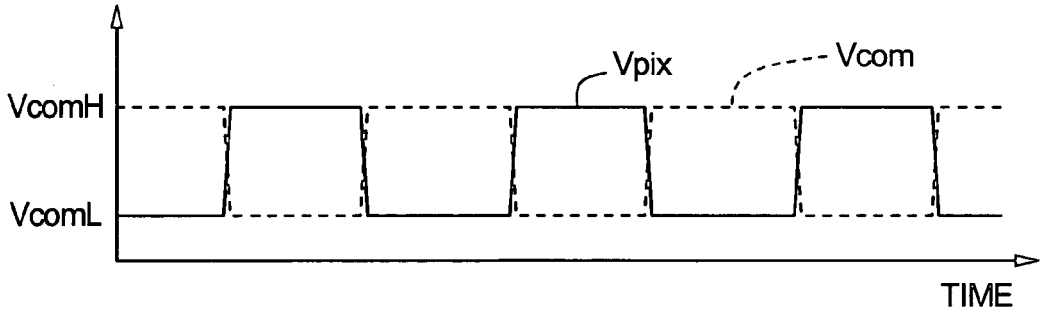
FIG. 15 PRIOR ART
FIG. 15 is a voltage waveform chart for the description of AC drive.

FIG. 1 is a circuit diagram showing an active matrix liquid crystal display device which is an embodiment mode of the active matrix display device according to the invention. As well as the conventional liquid crystal display device shown in FIG. 13, a liquid crystal display device 1 comprises a pixel matrix portion 10, a signal line driver circuit 11, a scan line driver circuit 12, a CPU 13, and a controller 14. In the pixel matrix portion 10, a plurality of pixels 20 are arranged in matrix.

Figure 2:
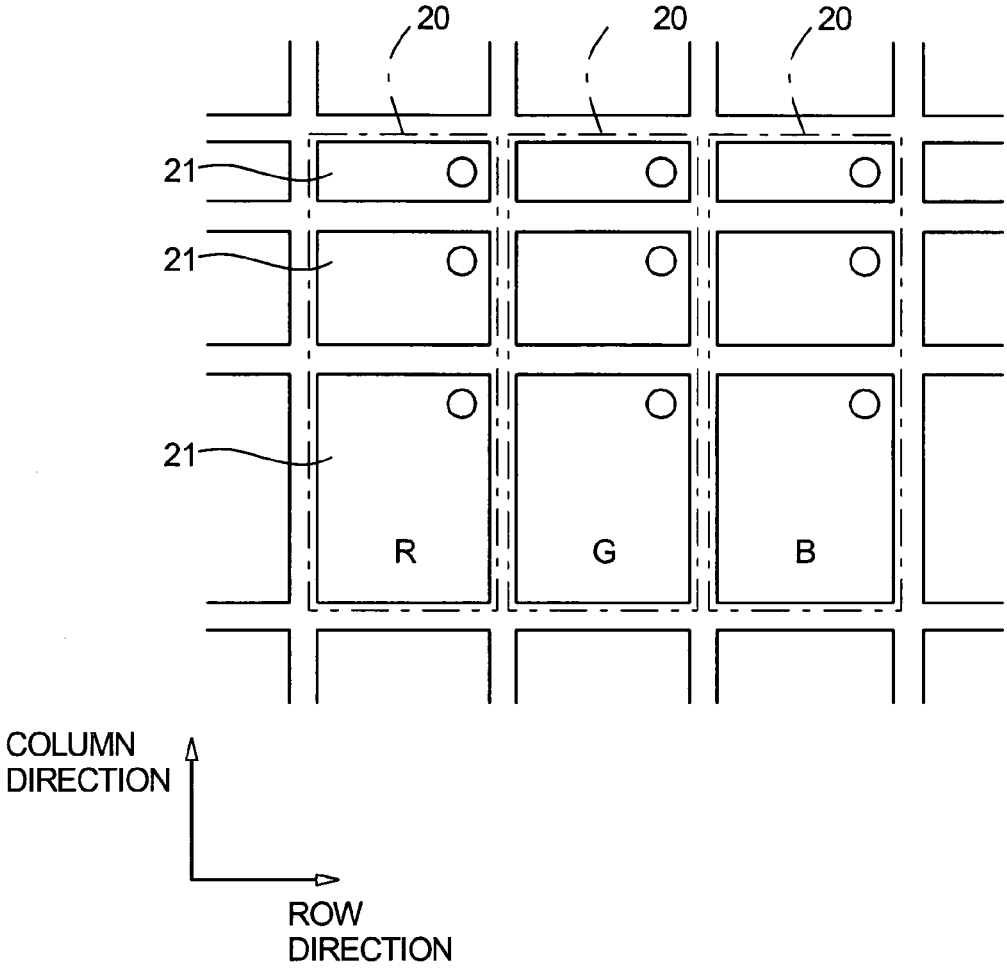
FIG. 2 is a plan view showing a part of a pixel matrix portion.

As shown in FIG. 2 which is a fragmental plan view of the pixel matrix portion 10, three liquid crystal cells 21 are allocated to each pixel 20 in this embodiment mode, and the display device is operated by using area gray scale with the number of indicator bits k of 3 (that is, 8-level gray scale). Needless to say, the number of indicator bits is not limited to three and other number of indicator bits can be used. Also as shown in FIG. 2, each pixel 20 corresponds to any one of red (R), green (G), and blue (B). Color display can be provided by adjusting display colors by the use of a set of three adjacent pixels with different colors (such a set of RGB pixels may be referred to as a pixel). Monochrome display may be provided of course. Further, the liquid crystal display device 1 may be any one of transmissive type, reflective type, and semi-transmissive type.

In FIG. 1, only a single pixel 20 and the corresponding elements are shown in the pixel matrix portion 10. In fact, a plurality of pixels 20 are arranged in matrix, in rows (lateral direction of the drawing) and in columns (longitudinal direction of the drawing), and signal lines 30 and a scan line 31 which correspond to each of the pixels 20 are arranged. A plurality of pixels 20 arranged in rows are also referred to as a pixel line, and a plurality of pixels 20 arranged in columns are also referred to as a pixel column. Besides, rows and columns are referred to as horizontal directions and perpendicular directions respectively. Thus, the pixel line is also referred to as a horizontal line. As well as in the conventional display device, each liquid crystal cell 21 comprises a pixel electrode 22, a counter electrode 23 is provided so as to face the pixel electrode 22, and a liquid crystal 24 is interposed between the pixel electrode 22 and the counter electrode 23.

According to the invention, a first memory circuit 40 and a second memory circuit 41 which are connected in series are provided between each pixel electrode 22 and the corresponding signal line 30. That is, the memory circuits 40 and 41 (six in total herein) twice as many as the indicator bits (3 herein) are provided for each pixel 20. Each of the first and second memory circuits 40 and 41 can have two states selectively and store binary data. A first switch 42 is provided between the first memory circuit 40 and the signal line 30, and a second switch 43 is provided between the first memory circuit 40 and the second memory circuit 41. Further, the liquid crystal display device 1 comprises a transfer control line driver circuit 45 for driving a transfer control line 44. The transfer control line 44 supplies a signal (transfer control signal) for controlling on/off of the second switch 43.

In FIG. 1, in order to achieve area gray scale with 3-indicator bits, three signal lines 30 (that is, equal in number to the indicator bits) extend from the signal line driver circuit 11 in each pixel column, and each of the three first switches 42 which are allocated to one of the pixels 20 is connected to different signal lines 30. A single scan line 31 extends from the scan line driver circuit 12 in each pixel line, and the three first switches 42 which are allocated to one of the pixels 20 are controlled on/off by signals on the same scan line 31. A single transfer control line 44 is also provided in each pixel line, and the three second switches 43 which are allocated to one of the pixels 20 are controlled on/off by signals on the same transfer control line 44.

Figure 3:
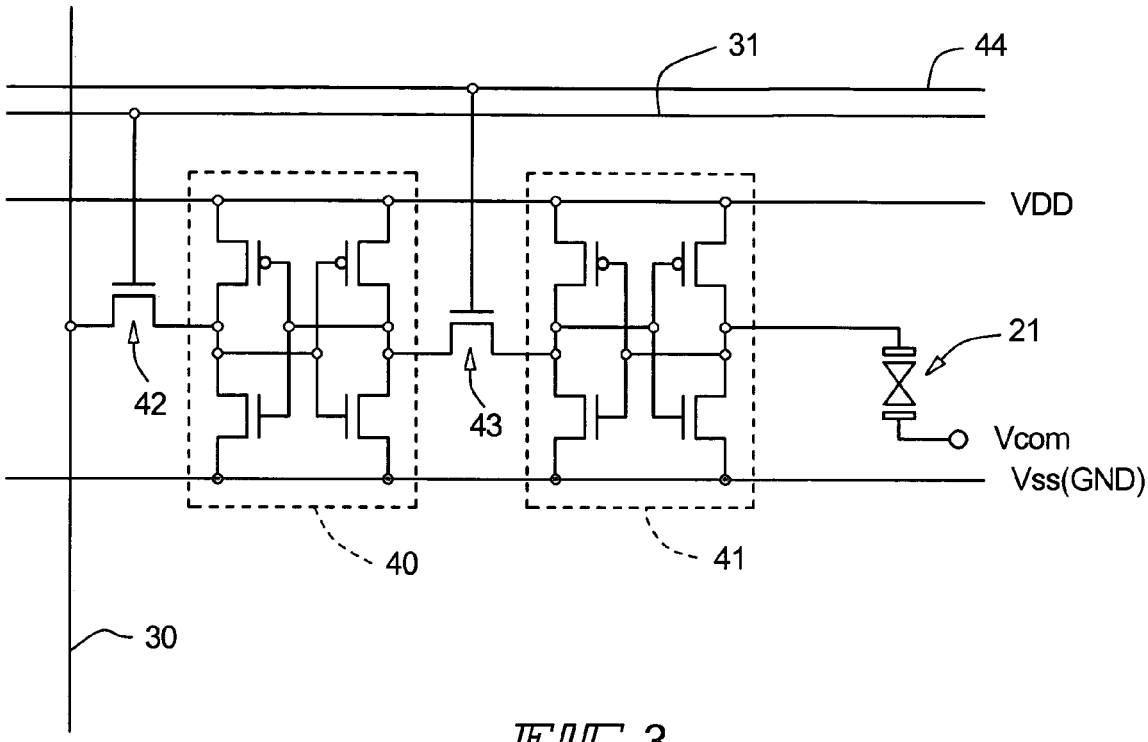
FIG. 3 is a circuit diagram showing an embodiment mode of first and second memory circuits and first and second switches for 1-bit.

FIG. 3 is a circuit diagram showing an embodiment mode of the first memory circuit 40, the second memory circuit 41, the first switch 42, and the second switch 43 which correspond to one of the liquid crystal cells 21 (that is, for 1-bit). In this embodiment mode, the first and second switches 42 and 43 are made up of TFTs which are of field effect transistor (FET) type. For the first and second memory circuits 40 and 41, a static RAM (SRAM) formed of two inverters is used. In FIG. 3, each of the inverters comprises two TFTs of different conductivity types, however, each of the inverters may be made up of a TFT and a resistor. Either a high level power supply potential VDD or a low level power supply potential VSS (e.g., a ground potential) is supplied to the first and second memory circuits 40 and 41. Accordingly, either a high level power supply potential VDD or a low level power supply potential VSS is applied to the pixel electrode 22 of the liquid crystal cell 21 depending on a state of the second memory circuit 41.

Figure 4:
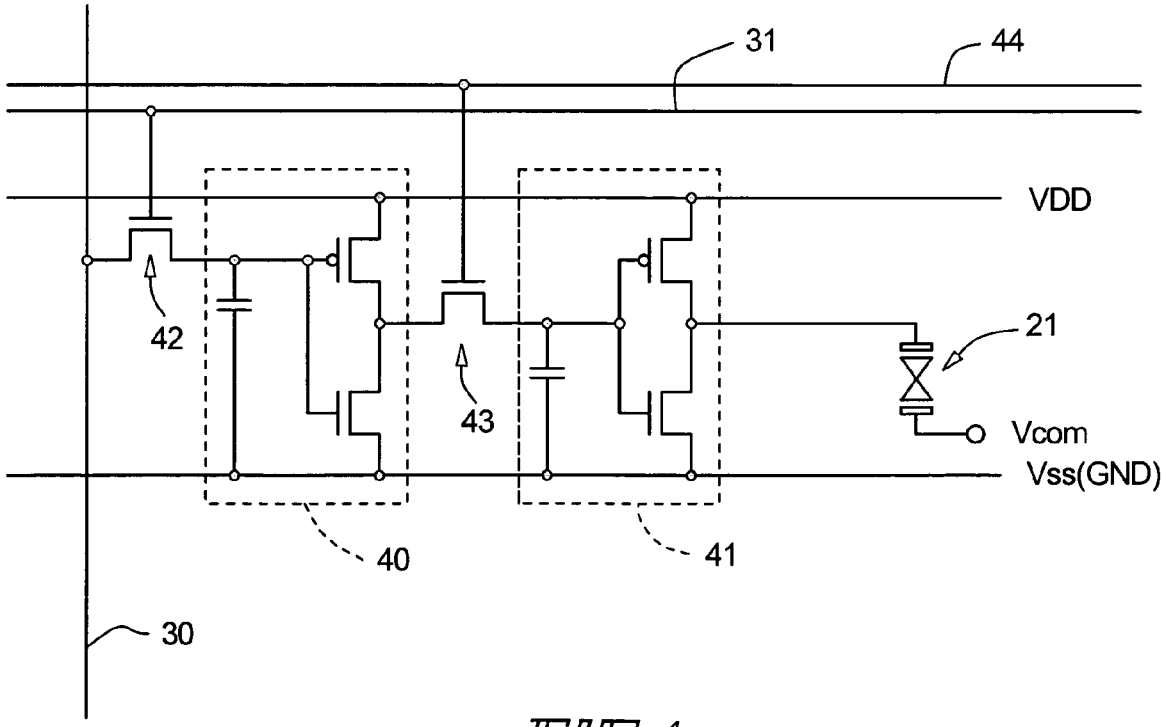
FIG. 4 is a circuit diagram showing another embodiment mode of first and second memory circuits and first and second switches for 1-bit.

FIG. 4 is a circuit diagram showing another embodiment mode of the first and second memory circuits 40 and 41. Only the elements which correspond to one of the liquid crystal cells 21 are shown in FIG. 4 as well as in FIG. 3. In this embodiment mode, a dynamic RAM (DRAM) including a capacitor is used for the first and second memory circuits 40 and 41. As well known, although DRAM needs to be refreshed periodically because the capacitor discharges with time, it has the advantage that it requires less elements than SRAM. In this embodiment mode as well as in the embodiment mode shown in FIG. 3, either a high level power supply potential VDD or a low level power supply potential VSS is applied to the pixel electrode 22 of the liquid crystal cell 21 depending on a state of the second memory circuit 41. In this manner, the first and second memory circuits 40 and 41 can be obtained by various known configurations.

Operation of the liquid crystal display device 1 described above will be explained hereinafter with reference to a timing chart of FIG. 5. It is assumed in the following description that a high level potential VH and a low level potential VL which are supplied from the corresponding driver circuits 11, 12 and 45 to the signal line 30, the scan line 31 and the transfer control line 44 respectively are equal to the high level power supply potential VDD and the low level power supply potential VSS which are applied to the memory circuits 40 and 41. In addition, a high level common potential VcomH and a low level common potential VcomL which determine an amplitude range of the counter electrode potential Vcom are also assumed substantially equal to the high level power supply potential VDD and the low level power supply potential VSS.

In general, an image signal is composed of a plurality of frames and each frame is composed of a scan period for setting data of each pixel 20 and a subsequent fly-back period. It is to be noted that a single frame may include a plurality of pairs of scan period and fly-back period (subframes) as in the case of using time gray scale. The case where a frame includes a single pair of scan period and fly-back period will be explained hereinafter, however, the invention can be applied to the case where a frame includes a plurality of subframes.

Figure 5:
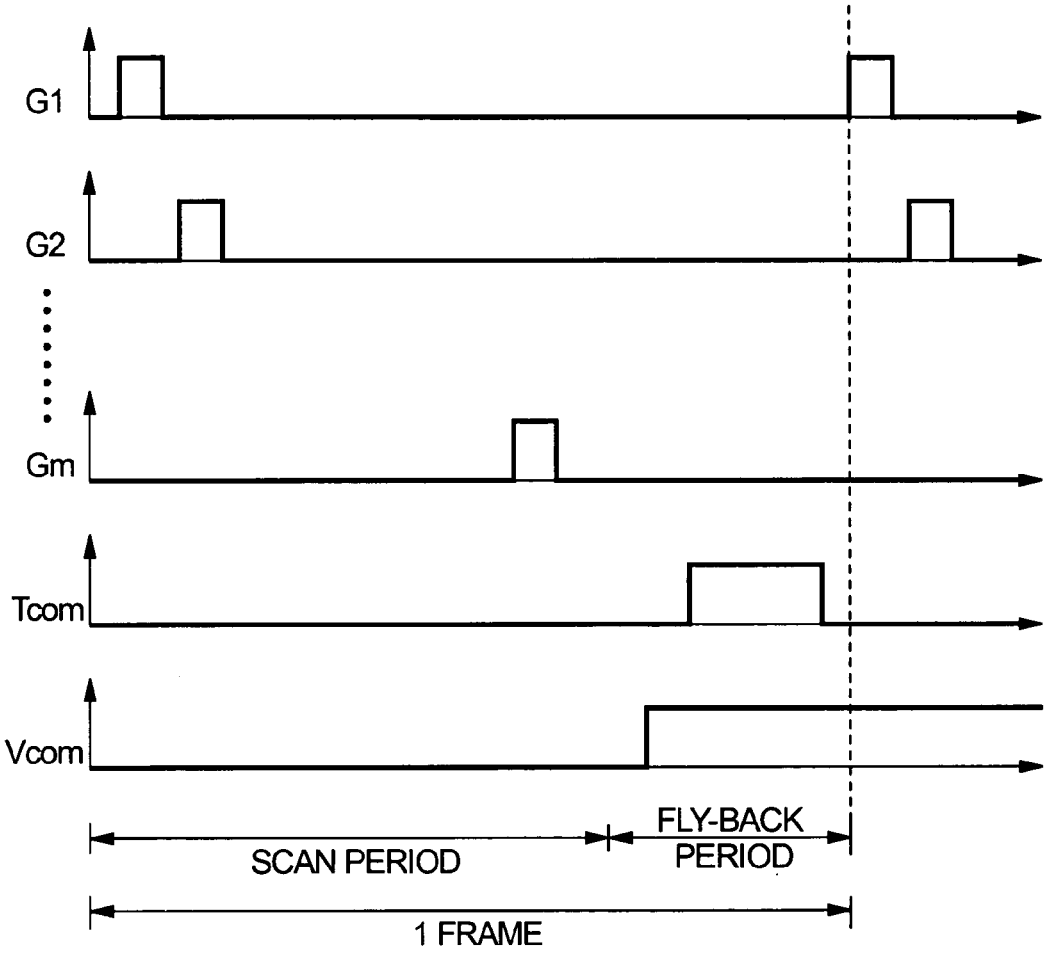
FIG. 5 is a timing chart showing an embodiment mode of operation of the liquid crystal display device shown in FIG. 1.
Figure 6:
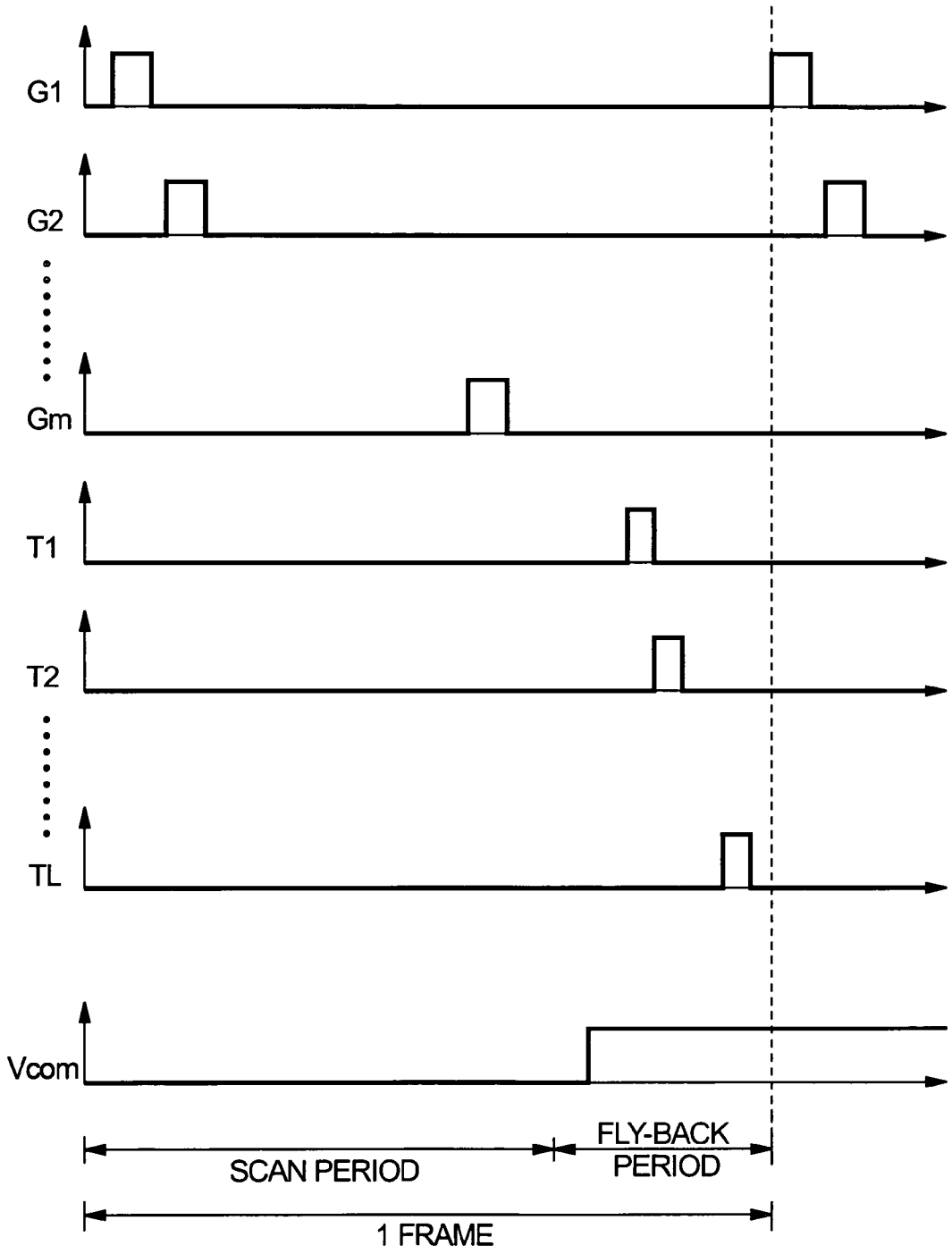
FIG. 6 is a timing chart showing another embodiment mode of operation of the liquid crystal display device shown in FIG. 1.

As shown in FIG. 5, when data (high level potential VH or low level potential VL) is supplied from the signal line driver circuit 11 to each of the signal lines 30 in a scan period, a selective signal (for example a high level potential) G1 is supplied to a first scan line 31, and the first switch 42 connected to the first scan line 31 is turned on. Thus, data from the signal line 30 is written to the first memory circuit 40. Subsequently, another data is supplied from the signal line driver circuit 11 to each of the signal lines 30, and a selective signal G2 is supplied to a second scan line 31. Then, the first switch 42 connected to the second scan line 31 is turned on and data is written to the corresponding first memory circuit 40. The same operation is performed for all the scan lines 31 (for example m scan lines) so as to write data to all the first memory circuits 40 for the entire screen. When writing data to the first memory circuits 40 is completed (that is, after the scan period), a potential Vcom of the counter electrode 23 is switched (from low level potential VSS to high level potential VDD in FIG. 5) in a fly-back period. Then, a common transfer signal (for example a high level potential) Tcom is supplied from the transfer control line driver circuit 45 to a plurality of transfer control lines 44 (equal in number to the scan lines 31, namely m lines in FIG. 1) in order to turn the second switch 43 on. As a result, data is transferred from each first memory circuit 40 to the corresponding second memory circuit 41. In the subsequent scan period, image display is performed in accordance with the data written to the second memory circuits 41, while writing another data for the subsequent fly-back period to the first memory circuits 40 in such manner as described above.

In the above-described active matrix liquid crystal display device 1, a pair of memory circuits (the first and second memory circuits 40 and 41) are provided for each liquid crystal cell 21 (or each pixel electrode 22). Accordingly, image display can be performed in a scan period by using data transferred from the first memory circuit 40 to the second memory circuit 41 in the preceding fly-back period, while writing to the first memory circuit 40 data corresponding to the potential Vcom of the counter electrode 23 set in the subsequent fly-back period. Thus, image display can be performed without distortion of the image in a scan period. Accordingly, image display having enough brightness can be easily achieved while reducing distortion of the image due to AC drive and maintaining enough period of image display.

Either a high level power supply potential VDD or a low level power supply potential VSS is supplied to the pixel electrode 22 of each liquid crystal cell 21 through the corresponding second memory circuit 41. Therefore, even when the potential Vcom of the counter electrode 23 is switched with AC drive between the high level common potential VcomH (equal to the high level power supply potential VDD here) and the low level common potential VcomL (equal to the low level power supply potential VSS here), the potential Vpix of the pixel electrode 22 is not influenced by this change. Since the potential Vpix of the pixel electrode 22 is not increased undesirably, low-voltage elements (such as TFTs) can be used and manufacturing costs can be reduced. Moreover, the pixel matrix portion 10, the driver circuits 11 and 12 and the like can be made up of the same type of low-voltage elements as used for the CPU 13 and the controller 14. It is thus possible to use transistors having a gate insulating layer of 50 nm or less in thickness and a gate of 2 $\mu$m or less in length. Accordingly, these circuits included in the liquid crystal display device 1 can be manufactured in a common process, and the manufacturing cost of the liquid crystal display device 1 can be considerably reduced.

Data can be transferred from the first memory circuit 40 to the second memory circuit 41 in a relatively short time. Therefore, in the case where a light source (not shown) such as a back light is turned on while the potential Vcom of the counter electrode 23 is switched and data from the first memory circuit 40 is transferred to the second memory circuit 41 in a fly-back period, distortion of the screen due to these operations can be minimized. The light source may be turned off in a fly-back period for less distortion of the screen.

In FIG. 5, a common transfer signal Tcom is simultaneously supplied to all the m transfer control lines 44, and data is transferred from the first memory circuits 40 to the second memory circuits 41 at the same time. In such a case, however, rapid transfer of electric charge may be caused and a power supply voltage may vary. In order to avoid these problems, the transfer control lines 44 may be divided into a plurality of groups (for example L groups), and transfer signals T1 to TL are supplied to each group with different timing so as to prevent a power supply voltage from varying. Grouping of the transfer control lines 44 can be performed arbitrarily. For example, when m transfer control lines are arranged in such order as 44-1, 44-2, . . . , 44-m, the m transfer control lines can be put together every fourth transfer control line, viewing the transfer control lines 44-1, 44-5, 44-9, . . . as a first group, the transfer control lines 44-2, 44-6, 44-10, . . . as a second group, the transfer control lines 44-3, 44-7, 44-11, . . . as a third group, and the transfer control lines 44-4, 44-8, 44-12, . . . as a fourth group (L=4 in this case). Alternatively, each group may include only a transfer control line 44 and a transfer signal may be supplied to each transfer control line 44 with different timing (L=m). Furthermore, in the case of simultaneously supplying a transfer signal to all the transfer control lines 44 as shown in FIG. 5, the transfer control lines 44 can be viewed as a single group (L= 1).

Figure 7:
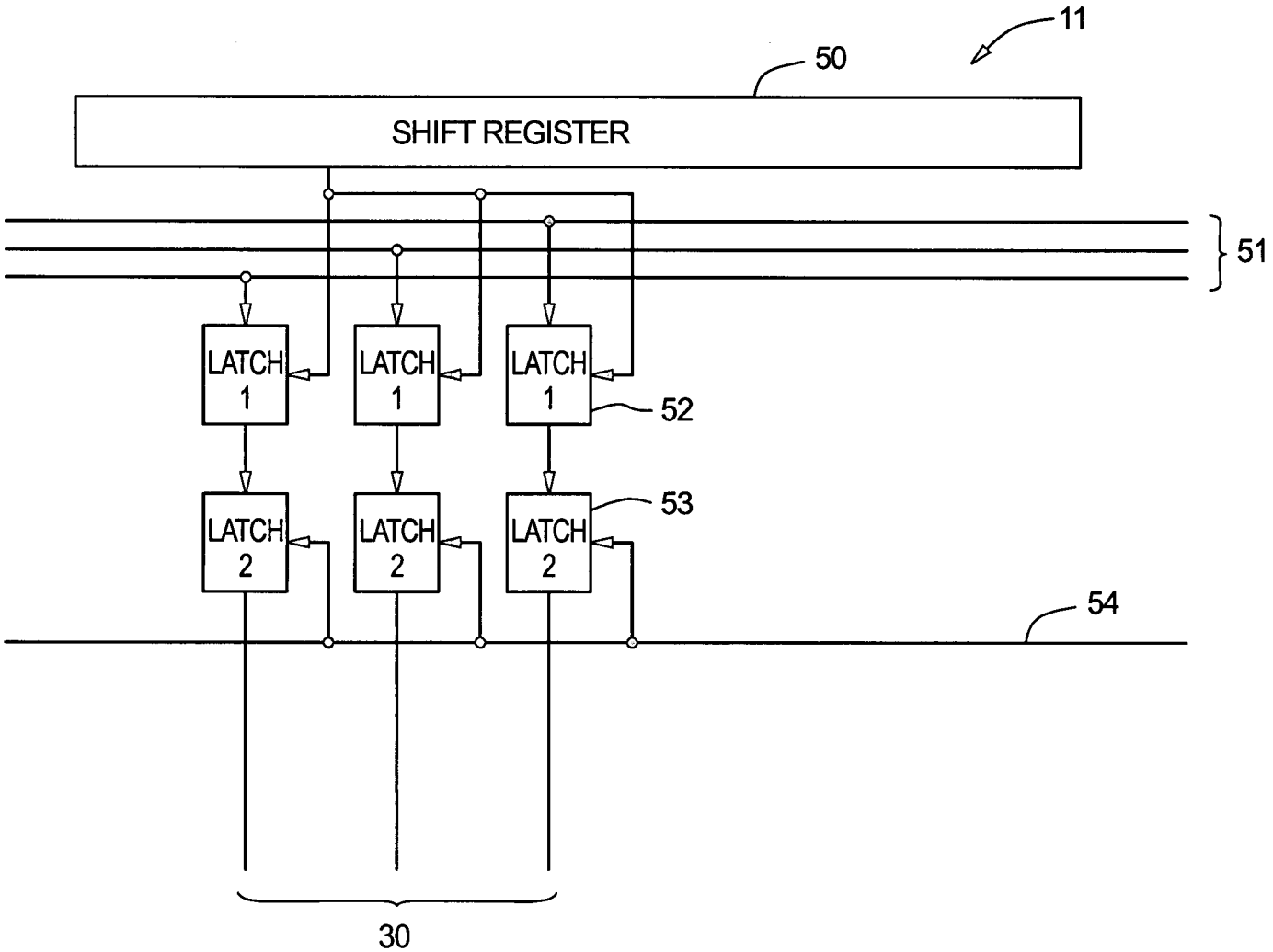
FIG. 7 is a view showing a frame format of an embodiment mode of the signal line driver circuit shown in FIG. 1.

FIG. 7 is a circuit diagram showing an embodiment mode of the signal line driver circuit 11 suitable for the liquid crystal display device 1 shown in FIG. 1 in which as many signal lines as the indicator bits are provided for each pixel column. The signal line driver circuit 11 comprises a shift register 50, a plurality of image data lines 51, a plurality of first latch circuits 52 for taking data from the image data lines 51 in accordance with a signal from the shift register 50, as many second latch circuits 53 as the first latch circuits 52, each of which is connected to an output of the corresponding first latch circuit 52, and a second latch circuit control line 54 for controlling the second latch circuits 53. The image data lines 51 are provided so as to be equal in number to the indicator bits (three here), and data for the corresponding bit is supplied to each image data line 51. Both the first latch circuits 52 and the second latch circuits 53 are provided so as to be equal in number to the indicator bits (three here) in one pixel column. The three first latch circuits 52 corresponding to each pixel column are each connected to different image data lines 51. That is, both the first latch circuits 52 and the second latch circuits 53 are equal in number to the liquid crystal cells 21 (pixel electrodes 22) included in one horizontal line. In this embodiment mode, each output of the three second latch circuits 53 corresponding to each pixel column is connected to a corresponding one of the three signal lines 30 provided for the pixel column. It is to be noted that only the first and second latch circuits 52 and 53 corresponding to one pixel column are shown in FIG. 7, in fact, they are provided for a plurality of pixel columns.

Operation of such signal line driver circuit 11 is explained hereinafter. First, bit data for a pixel 20 is supplied to each of the image data lines 51. Then, a control signal is supplied from the shift register 50 to the first latch circuit 52 corresponding to the pixel 20, and the data on the image data lines 51 is taken in the first latch circuit 52. Subsequently, another bit data for the adjacent pixel 20 on the same pixel line is supplied to the image data lines 51. Then, a signal is supplied from the shift register 50 to the first latch circuit 52 corresponding to the pixel 20, and the data is written to the first latch circuit 52. Data for all the pixels 20 included in one horizontal line is written to the first latch circuits 52 in this manner. Then, control signals are supplied to each of the second latch circuits 53 through the second latch circuit control line 54, and the data is transferred from the first latch circuits 52 to the corresponding second latch circuits 53. As an output of each second latch circuit 53 is connected to the corresponding signal line 30, the data is supplied to each signal line 30. When a signal for turning on is supplied to the scan line 31 (FIG. 1) at this time, data on the signal line 30 is written to the first memory circuit 40 connected to the scan line 31 as described above.

In the liquid crystal display device 1 shown in FIG. 1, three signal lines 30 and a single scan line 31 are provided for a single pixel 20. The scan line 31 can be used in common between the pixels 20 included in one horizontal line. Therefore, for a set of pixels composed of three RGB pixels 20, nine signal lines 30 and a single scan line 31 are required. In general, as shown in FIG. 2, a plurality of (three here) liquid crystal cells 21 (or pixel electrodes 22) included in the pixel 20 for each color are arranged in columns, each pixel 20 is vertically long and each set of RGB pixels is substantially square. Accordingly, the density of the signal lines may be increased, and the layout thereof may be complicated in such embodiment mode. To solve the problems, another embodiment mode in which the number of signal lines 30 can be reduced and that of scan lines 31 can be increased is shown in FIGS. 8 and 9.

Figure 8:
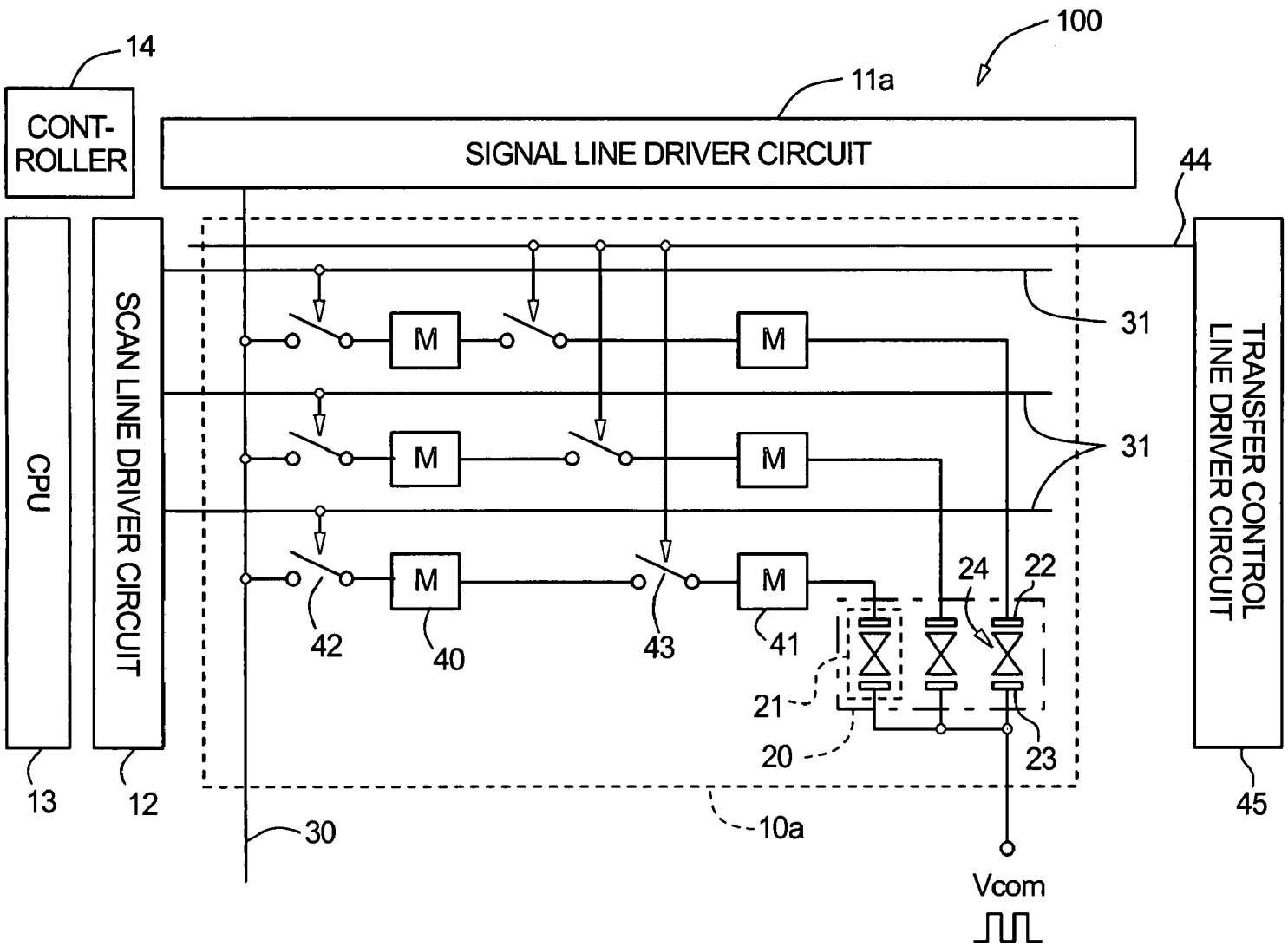
FIG. 8 is a circuit diagram showing a frame format of a modification of the liquid crystal display device 1 shown in FIG. 1.

FIG. 8 is a circuit diagram showing a modification of the liquid crystal display device 1 shown in FIG. 1. In FIG. 8, like components are denoted by like reference numerals as of FIG. 1 and will be explained in no more details. In a pixel matrix portion 10*a* of a liquid crystal display device 100, the three first memory circuits 40 allocated to a pixel are connected to the same signal line 30 through the corresponding first switches 42. Each of the first switches 42 is connected to different scan lines 31. That is, in this embodiment mode, a single signal line 30 is provided for one pixel column and three scan lines 31 are provided for one horizontal line.

Figure 9:
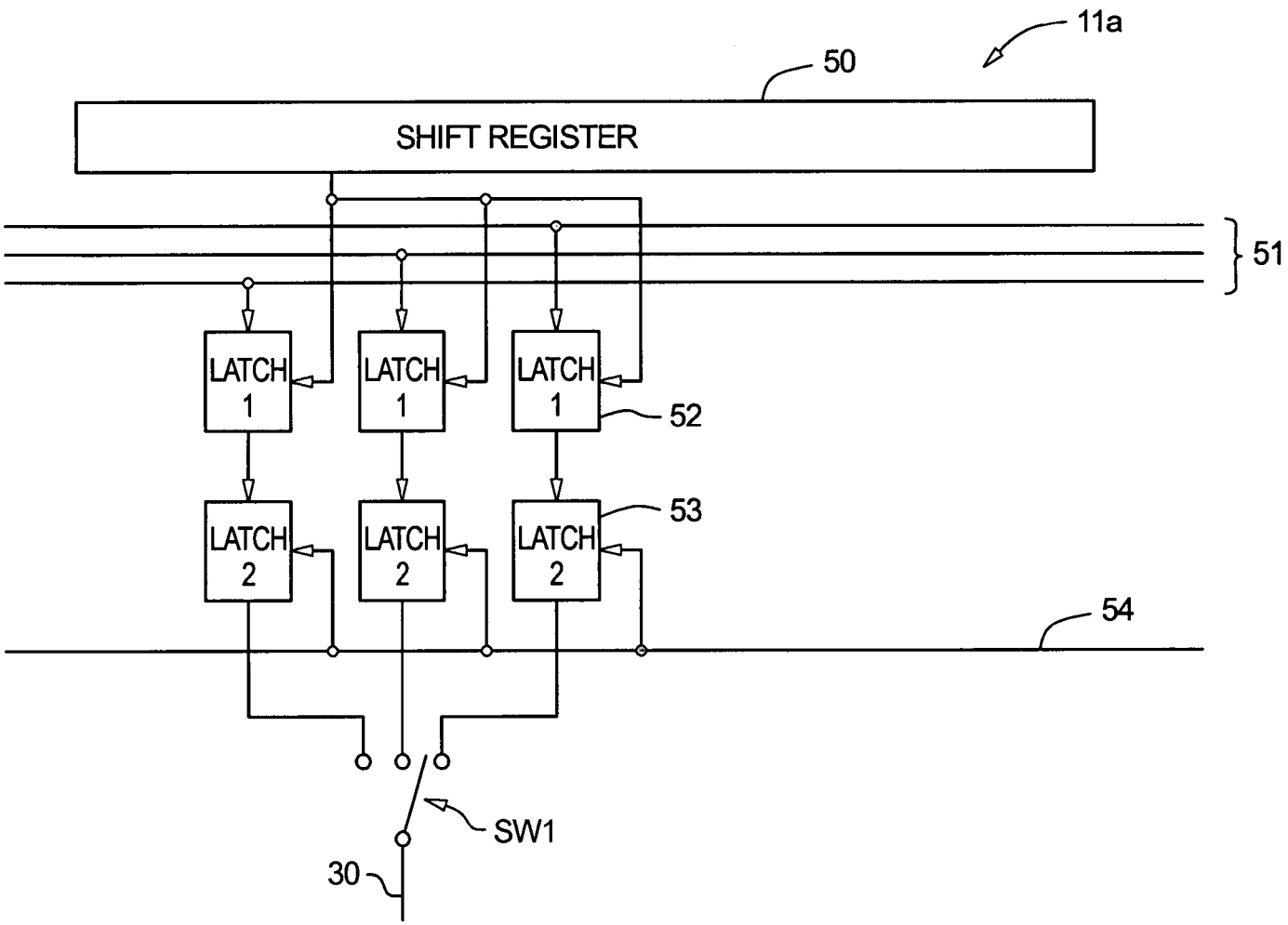
FIG. 9 is a view showing a frame format of an embodiment mode of the signal line driver circuit shown in FIG. 8.

FIG. 9 is a circuit diagram showing an embodiment mode of the signal line driver circuit suitable for the liquid crystal display device 100 shown in FIG. 8. In FIG. 9, like components are denoted by like reference numerals as of FIG. 7 and will be explained in no more details. A signal line driver circuit 11*a* differs from the embodiment mode shown in FIG. 7 in that outputs of the three second latch circuits 53 allocated to one pixel column are connected to one signal line 30 through a selective switch SW1.

Operation of the signal line driver circuit 11*a* shown in FIG. 9 is similar to that of the signal line driver circuit 11 shown in FIG. 7, in that data is taken in the second latch circuits 53. However, the operation differs in that a signal to be outputted to the signal line 30 is sequentially selected from the three second latch circuits 53 through the selective switch SW1. The first switches 42 of the pixel matrix portion 10 shown in FIG. 8 are operated in synchronism with the selective switch SW1 of the signal line driver circuit 11a, and write data on the signal line 30 to the corresponding first memory circuit 40. For example, when the right side second latch circuit 53 in FIG. 9 is connected to the signal line 30, the upper first switch 42 in FIG. 8 is turned on, when the central second latch circuit 53 is connected to the signal line 30, the central first switch 42 is turned on, and when the left side second latch circuit 53 is connected to the signal line 30, the lower first switch 42 is turned on. In this manner, bit data for the pixel 20 is written to the corresponding first memory circuit 40 with time division in this embodiment mode. Other operation is the same as that of the liquid crystal display device 1 shown in FIG. 1.

As described above, according to the embodiment mode shown in FIGS. 8 and 9, each pixel column requires only a single signal line, thus the layout of the signal lines 30 can be simplified.

Figure 10:
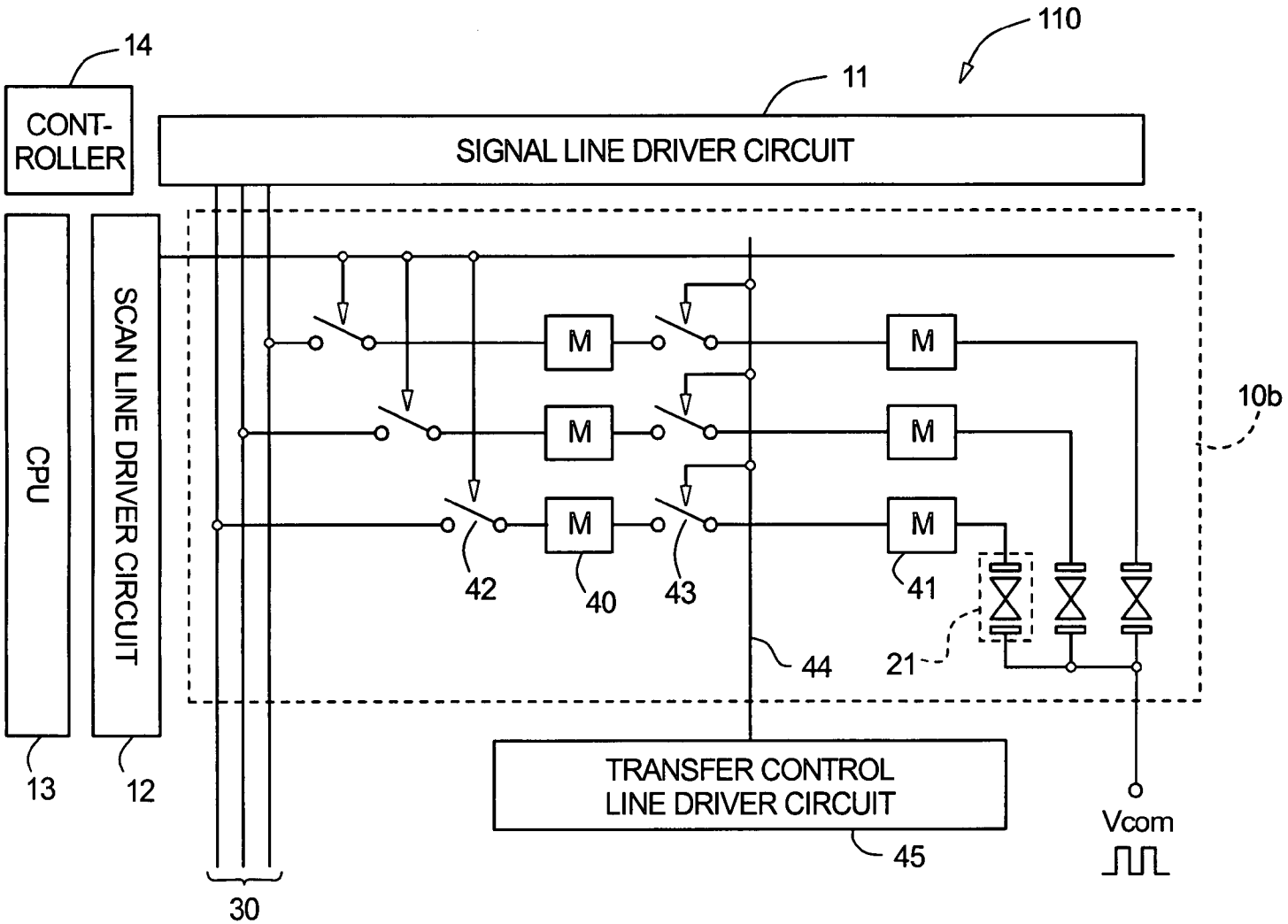
FIG. 10 is a circuit diagram showing another modification of the liquid crystal display device 1 shown in FIG. 1.

FIG. 10 is a circuit diagram showing a modification of the liquid crystal display device 1 shown in FIG. 1. In FIG. 10, like components are denoted by like reference numerals as of FIG. 1. A liquid crystal display device 110 shown in FIG. 10 differs from the liquid crystal display device 1 in that the transfer control line 44 is arranged parallel to the signal lines 30 in columns in a pixel matrix portion 10*b*. However, the liquid crystal display device 110 is operated in the same manner as the liquid crystal display device 1, and has the same advantageous effect. Thus, the transfer control signal line 44 can be arranged either in rows or in columns.

Figure 11:
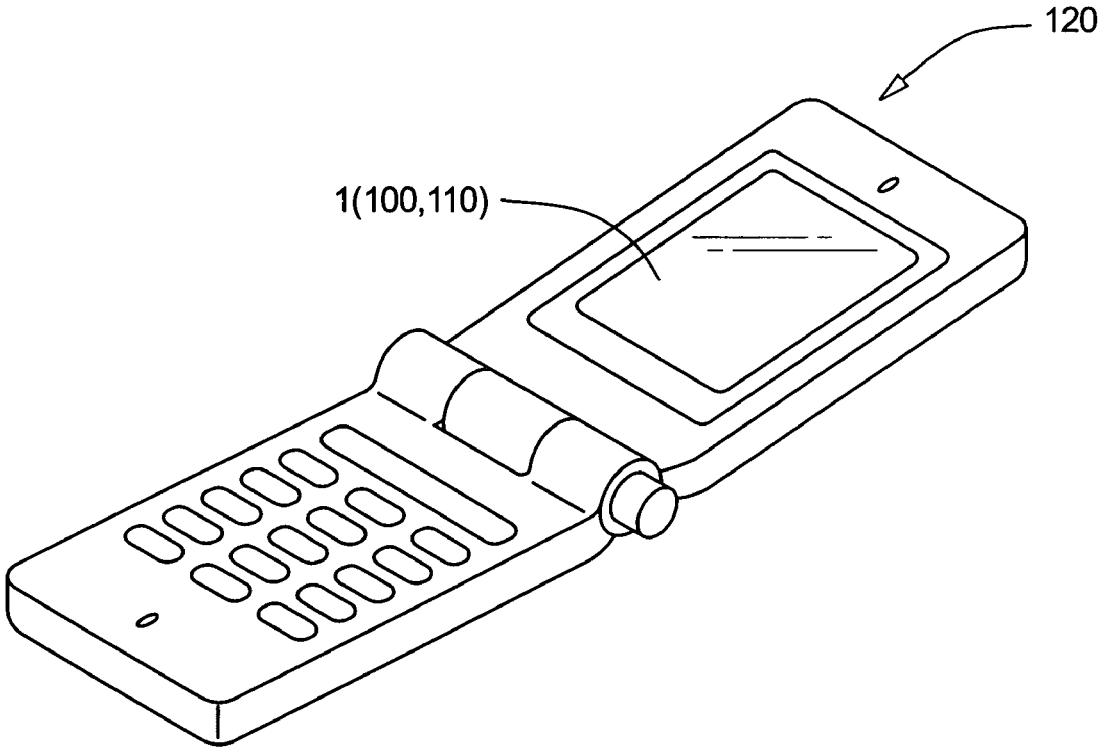
FIG. 11 is a view showing a frame format of a mobile phone which is an example of electronic equipment.

The above-described liquid crystal display devices 1, 100 and 110 can be applied to various types of electronic equipment such as a mobile phone, a digital camera, a video camera, a PDF, a notebook computer, a wrist watch, a portable DVD player, a projector, and a portable book (electronic book), though the invention is not limited to these. A mobile phone 120 is shown as an example of such electronic equipment in FIG. 11.

Figure 12:
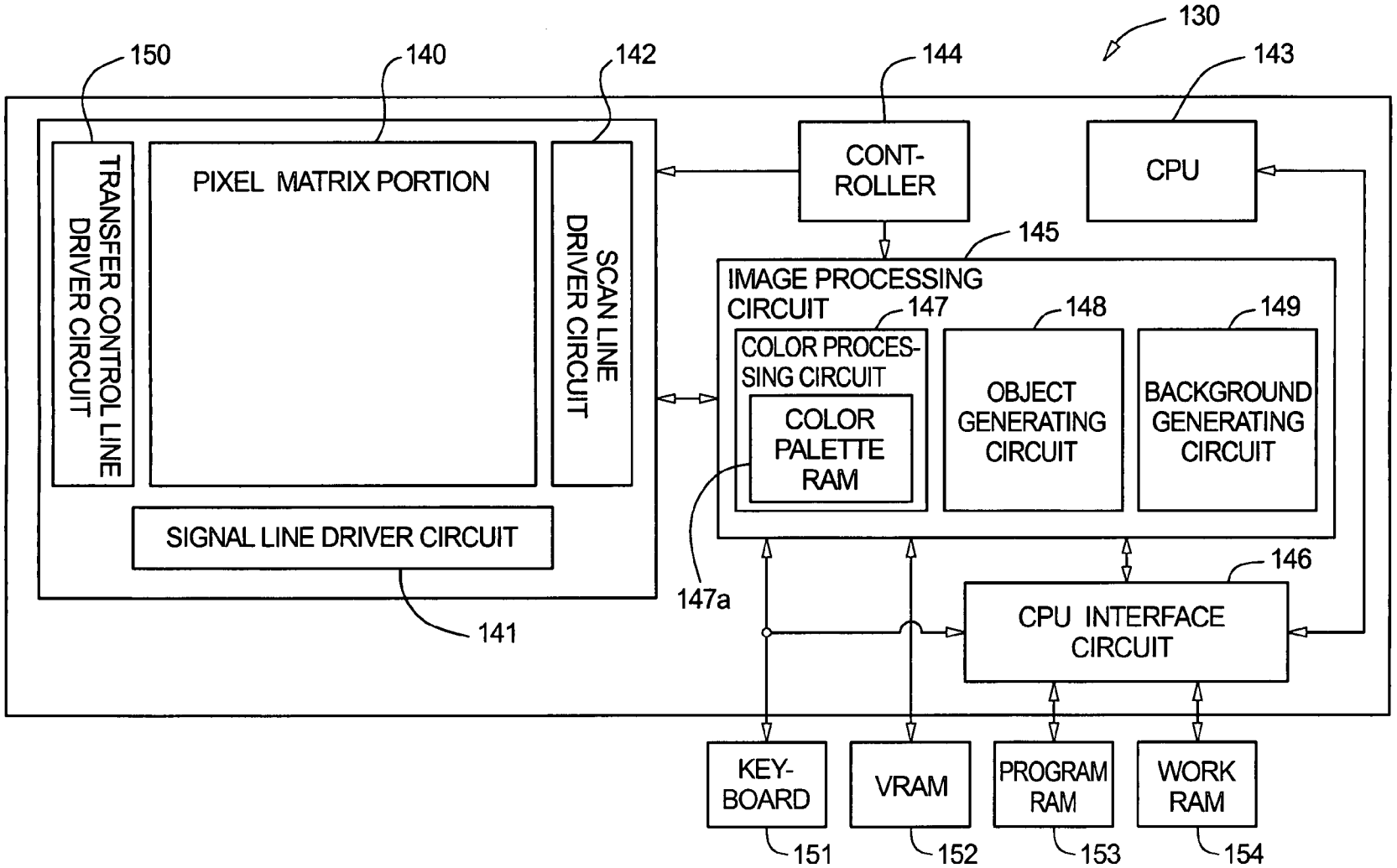
FIG. 12 is a block diagram showing an example of integral display device containing a liquid crystal display device and a game console, to which the invention can be applied.

FIG. 12 is a block diagram showing an integral display device containing a liquid crystal display device and a game console, to which the invention can be applied. An integral liquid crystal display device 130 comprises a pixel matrix portion (or a liquid crystal display portion) 140, a signal line driver circuit 141, a scan line driver circuit 142, a transfer control line driver circuit 150, a CPU 143, a controller 144, an image processing circuit 145, and a CPU interface circuit 146. For the pixel matrix portion 140, any of the pixel matrix portions 10, 10*a* and 10*b* respectively shown in FIGS. 1, 8, and 10 can be used. The signal line driver circuit 141, the scan line driver circuit 142 and the transfer control line driver circuit 150 correspond respectively to the signal line driver circuit 11, the scan line driver circuit 12 and the transfer control line driver circuit 45 which are shown in FIG. 1 for example. The CPU 143 and the controller 144 correspond respectively to the CPU 13 and the controller 14 which are shown in FIG. 1.

The image processing circuit 145 comprises a color processing circuit 147, an object generating circuit 148, a background generating circuit 149 and the like. The object generating circuit 148 is used for producing game characters and the background generating circuit 149 is used for producing backgrounds of the characters. The color processing circuit 147 includes a color palette memory 147*a* for controlling colors of the characters and the backgrounds. The image processing circuit 145 is connected to a video RAM (VRAM) 152 to which data to be displayed on screen is written. The CPU 143 controls the image processing circuit 145 and external memories (e.g., a program RAM 153, a work RAM 154 and the like) by an input from an input device such as a keyboard 151. The CPU interface circuit 146 is located between the CPU 143 and the image processing circuit 145 and between the CPU 143 and external devices (the keyboard 151, the program RAM 153, the work RAM 154 and the like). The CPU interface circuit 146 provides interface functions such as timing adjustment between the CPU 143 and the image processing circuit 145. The controller 144 controls timing of the signal line driver circuit 141, the scan line driver circuit 142, the transfer control line driver circuit 150, and the image processing circuit 145. These logic circuits (the CPU 143, the controller 144, the image processing circuit 145, and the CPU interface circuit 146) are preferably operated with as low voltage as possible in order to increase operating speed and reduce power consumption. In addition, when these logic circuits are made up of TFTs, it is desirable to use a low-voltage TFT in which the gate length and the thickness of a gate insulating layer are reduced as much as possible. According to the invention, such a low-voltage TFT can be used in common in the display device 130 incorporating the liquid crystal display portion 140 and the logic circuits having many elements. Therefore, manufacturing process of the display device can be considerably simplified.

Although the present invention has been fully described by way of example with reference to the accompanying drawings, it is to be understood that various changes and modifications will be apparent to those skilled in the art. Therefore, unless otherwise such changes and modifications depart from the scope of the invention hereinafter defined, they should be constructed as being included therein.

For example, the active matrix display device using area gray scale is described in the embodiment modes above, though the invention can be applied to an active matrix display device using time gray scale. In the latter case, a single frame may be divided into a plurality of subframes, and the counter electrode potential may be switched per subframe. Further, although FETs are used for the TFTs in the embodiment modes above, other types of transistor such as a bipolar transistor can also be used. Moreover, the invention can be applied to the active matrix display device without using gray scale (that is, each pixel has either on or off state). The second switch 43 is divided into a plurality of groups, and each group is turned on with different timing in order to transfer data from the corresponding first memory circuit 40 to the second memory circuit 41. These examples should be included in the scope of the invention.

According to the above-described active matrix display device, a pair of memory circuits (a first memory circuit and a second memory circuit) are provided for each pixel electrode. Therefore, in a first period (scan period), image display can be performed by using data transferred from the first memory circuit to the second memory circuit in the preceding second period, while sequentially turning first switches on and writing to the first memory circuit data corresponding to a counter electrode potential set in the subsequent second period (fly-back period). Thus, image display can be performed in the first period without distortion of the image. Accordingly, image display having enough brightness can be easily achieved while reducing distortion of the image due to AC drive and maintaining enough period of image display.

Either of two different potentials (a high level power supply potential VDD or a low level power supply potential VSS) is supplied to each pixel electrode through the corresponding second memory circuit. Therefore, even when the potential of a counter electrode is switched between first and second potentials with AC drive, the potential of the pixel electrode (Vpix) is not influenced by this change. Since the potential of the pixel electrode is not increased undesirably, low-voltage elements (such as TFTs) can be used and manufacturing costs can be reduced.

What is claimed is:

1. An active matrix display device comprising:

a display medium interposed between a pair of substrates;

a plurality of signal lines and a plurality of scan lines, each supported by one of the pair of substrates and intersecting each other;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line.

2. An active matrix display device comprising:

a display medium interposed between a pair of substrates;

a plurality of signal lines and a plurality of scan lines, each supported by one of the pair of substrates and intersecting each other;

a signal line driver circuit for driving the plurality of signal lines;

a scan line driver circuit for driving the plurality of scan lines;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line, wherein a plurality of the pixel electrodes are allocated to each pixel;

the signal lines are provided so as to be equal in number to the pixel electrodes included in one horizontal line; and each of the plurality of first switches corresponding to a plurality of the pixel electrodes allocated to each pixel is connected to a corresponding signal line.

3. An active matrix display device according to claim 2, wherein the signal line driver circuit comprises as many latch circuits as a plurality of pixel electrodes included in one horizontal line in order to store data corresponding to the plurality of pixel electrodes; and each of the signal lines is connected to a corresponding one of the plurality of latch circuits.

4. An active matrix display device comprising:

a display medium interposed between a pair of substrates;

a plurality of signal lines and a plurality of scan lines, each supported by one of the pair of substrates and intersecting each other;

a signal line driver circuit for driving the plurality of signal lines;

a scan line driver circuit for driving the plurality of scan lines;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line, wherein a plurality of the pixel electrodes are allocated to each pixel;

the signal lines are provided so as to be equal in number to the pixel electrodes included in one horizontal line;

a plurality of the first switches corresponding to a plurality of the pixel electrodes allocated to each pixel are connected to one of the signal lines; and a plurality of the first switches corresponding to a plurality of the pixel electrodes allocated to each pixel are connected to different scan lines.

5. An active matrix display device according to claim 4, wherein the signal line driver circuit comprises a plurality of latch circuits for storing data corresponding to a plurality of pixel electrodes allocated to each pixel included in one horizontal line, and as many selective switches as the signal lines, which are provided between the latch circuits and the signal lines in order to select data to be transferred to the signal lines among data stored in the latch circuits.

6. An active matrix display device according to any one of claims 4 and 5, wherein a plurality of pixel electrodes allocated to each pixel are arranged parallel to the signal lines.

7. An active matrix display device comprising:

a display medium interposed between a pair of substrates;

a plurality of signal lines and a plurality of scan lines, each supported by one of the pair of substrates and intersecting each other;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line, wherein a plurality of the pixel electrodes are allocated to each pixel and an area gray scale is used in the display device.

8. An active matrix display device comprising:

a display medium interposed between a pair of substrates;

a plurality of signal lines and a plurality of scan lines, each supported by one of the pair of substrates and intersecting each other;

a signal line driver circuit for driving the plurality of signal lines;

a scan line driver circuit for driving the plurality of scan lines;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line, wherein a plurality of the pixel electrodes are allocated to each pixel;

the signal lines are provided so as to be equal in number to the pixel electrodes included in one horizontal line;

each of the plurality of first switches corresponding to a plurality of the pixel electrodes allocated to each pixel is connected to a corresponding signal line; and an area gray scale is used in the display device.

9. An active matrix display device comprising:

a display medium interposed between a pair of substrates;

a plurality of signal lines and a plurality of scan lines, each supported by one of the pair of substrates and intersecting each other;

a signal line driver circuit for driving the plurality of signal lines;

a scan line driver circuit for driving the plurality of scan lines;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line, wherein a plurality of the pixel electrodes are allocated to each pixel;

the signal lines are provided so as to be equal in number to the pixel electrodes included in one horizontal line;

a plurality of the first switches corresponding to a plurality of the pixel electrodes allocated to each pixel are connected to one of the signal lines;

a plurality of the first switches corresponding to a plurality of the pixel electrodes allocated to each pixel are connected to different scan lines; and an area gray scale is used in the display device.

10. An active matrix display device according to any one of claims 1, 2, 4 and 7–9, wherein the matrix display device comprises a first period for turning the first switches on and writing data to the first memory circuits, and a second period for turning the second switches on and transferring data from the each of the first memory circuits to a corresponding one of the second memory circuits, after writing data to each of the first memory circuits in the first period; and a potential of the counter electrode is switched between a first potential and a second potential in the second period.

11. An active matrix display device according to claim 10, wherein the second period comprises a fly-back period of an image signal.

12. An active matrix display device according to claim 11, wherein a potential of the counter electrode is switched per frame of an image signal.

13. An active matrix display device according to claim 12, wherein one of two different potentials supplied to a corresponding pixel electrode through the second memory circuit is substantially equal to the first potential, and the other is substantially equal to the second potential.

14. An active matrix display device according to any one of claims 1, 2, 4 and 7–9, wherein the first switch and the second switch comprise a thin film transistor, the first memory circuit and the second memory circuit comprise an SRAM or a DRAM, each having a thin film transistor.

15. An active matrix display device according to claim 1, further comprising a signal line driver circuit for driving the plurality of signal lines, a scan line driver circuit for driving the plurality of scan lines, and a logic circuit, wherein the signal line driver circuit, the scan line driver circuit, the transfer control line driver circuit, the first and second memory circuits, the first and second switches, and the logic circuit comprise a same type of thin film transistor.

16. An active matrix display device according to any one of claims 2, 4 and 7–9, further comprising a logic circuit, wherein the signal line driver circuit, the scan line driver circuit, the transfer control line driver circuit, the first and second memory circuits, the first and second switches, and the logic circuit comprise a same type of thin film transistor.

17. An active matrix display device according to claim 15, wherein the logic circuit comprises a controller for controlling timings of the signal line driver circuit, the scan line driver circuit and the transfer control line driver circuit.

18. An active matrix display device according to claim 15, wherein the logic circuit includes a CPU.

19. An active matrix display device according to claim 15, wherein the logic circuit includes an image processing circuit.

20. An active matrix display device according to claim 16, wherein the logic circuit comprises a controller for controlling timings of the signal line driver circuit, the scan line driver circuit and the transfer control line driver circuit.

21. An active matrix display device according to claim 16, wherein the logic circuit includes a CPU.

22. An active matrix display device according to claim 16, wherein the logic circuit includes an image processing circuit.

23. An active matrix display device according to any one of claims 1, 2 and 4, wherein digital gray scale is used in the display device.

24. An active matrix display device according to any one of claims 1, 2, 4 and 7–9, wherein the transfer control line is arranged substantially parallel to the signal lines.

25. An active matrix display device according to any one of claims 1, 2, 4 and 7–9, wherein the transfer control line is arranged substantially perpendicular to the signal lines.

26. An active matrix display device according to any one of claims 1, 2, 4 and 7–9, further comprising a plurality of the transfer control lines, wherein the transfer control lines are divided into a plurality of groups, and the transfer signal is supplied to each of the groups with different timing.

27. An active matrix display device according to any one of claims 1, 2, 4 and 7–9, wherein the display medium comprises a liquid crystal.

28. An active matrix display device according to any one of claims 7 to 9, wherein k (k is an integer of 2 or more) pixel electrodes are allocated to each of the pixels, and the area ratio between the pixel electrodes is $1:2:4 \ldots :2^{k-1}$ as the basis of the minimum pixel electrode area.

29. Electronic equipment comprising an active matrix display device according to any one of claims 1, 2, 4 and 7–9.

30. A driving method of an active matrix display device comprising a display medium interposed between a pair of substrates, wherein the active matrix display device comprises:

a plurality of signal lines and a plurality of scan lines, each supported by one of the pair of substrates and intersecting each other;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line, wherein the driving method comprises the steps of:

turning the first switches on and writing data to the first memory circuits in a first period;

turning the second switches on and transferring data from the first memory circuits to a corresponding one of the second memory circuits in a second period, after writing data to each of the first memory circuits in the first period; and switching a potential of the counter electrode between a first potential and a second potential in the second period.

31. A driving method of an active matrix display device comprising a display medium interposed between a pair of substrates, wherein the active matrix display device comprises:

a plurality of signal lines and a plurality of scan lines, each supported by one of the pair of substrates and intersecting each other;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line, wherein the driving method comprises the steps of:

turning the first switches on and writing data to the first memory circuits in a first period;

turning the second switches on and transferring data from the first memory circuits to a corresponding one of the second memory circuits in a second period, after writing data to each of the first memory circuits in the first period; and switching a potential of the counter electrode between a first potential and a second potential in the second period, wherein the second period comprises a fly-back period of an image signal.

32. A driving method of an active matrix display device, according to any one of claims 30 and 31, wherein a potential of the counter electrode is switched per frame of an image signal.

33. A driving method of an active matrix display device comprising a display medium interposed between a pair of substrates, wherein the active matrix display device comprises:

a plurality of signal lines and a plurality of scan lines, each supported by one of the pair of substrates and intersecting each other;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line, wherein the driving method comprises the steps of:

turning the first switches on and writing data to the first memory circuits in a first period;

turning the second switches on and transferring data from the first memory circuits to a corresponding one of the second memory circuits in a second period, after writing data to each of the first memory circuits in the first period; and switching a potential of the counter electrode between a first potential and a second potential in the second period, wherein a plurality of the pixel electrodes are allocated to each pixel and each of the pixel electrodes has a corresponding liquid crystal cell; and an area gray scale is used in the display device by changing a combination of liquid crystal cells which transmit light in each pixel.

34. A driving method of an active matrix display device comprising a display medium interposed between a pair of substrates, wherein the active matrix display device comprises:

a plurality of signal lines and a plurality of scan lines, each supported by one of the pair of substrates and intersecting each other;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line, wherein the driving method comprises the steps of:

turning the first switches on and writing data to the first memory circuits in a first period;

turning the second switches on and transferring data from the first memory circuits to a corresponding one of the second memory circuits in a second period, after writing data to each of the first memory circuits in the first period; and switching a potential of the counter electrode between a first potential and a second potential in the second period, wherein the second period comprises a fly-back period;

a plurality of the pixel electrodes are allocated to each pixel and each of the pixel electrodes has a corresponding liquid crystal cell; and an area gray scale is used in the display device by changing a combination of liquid crystal cells which transmit light in each pixel.

35. A driving method of an active matrix display device comprising a display medium interposed between a pair of substrates, wherein the active matrix display device comprises:

a plurality of signal lines and a plurality of scan lines, each supported by one of the pair of substrates and intersecting each other;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line, wherein the driving method comprises the steps of:

turning the first switches on and writing data to the first memory circuits in a first period;

turning the second switches on and transferring data from the first memory circuits to a corresponding one of the second memory circuits in a second period, after writing data to each of the first memory circuits in the first period; and switching a potential of the counter electrode between a first potential and a second potential in the second period, wherein a potential of the counter electrode is switched per frame of an image signal;

a plurality of the pixel electrodes are allocated to each pixel and each of the pixel electrodes has a corresponding liquid crystal cell; and an area gray scale is used in the display device by changing a combination of liquid crystal cells which transmit light in each pixel.

36. A driving method of an active matrix display device comprising a display medium interposed between a pair of substrates, wherein the active matrix display device comprises:

a plurality of signal lines and a plurality of scan lines, each supported by one of the pair of substrates and intersecting each other;

a plurality of pixel electrodes supported by the one of the pair of substrates and arranged in matrix;

a counter electrode supported by the other of the pair of substrates and interposing the display medium between the pixel electrodes;

a plurality of pairs of memory circuits, each provided between each of the pixel electrodes and a corresponding one of the signal lines, wherein each pair of memory circuits comprises a first memory circuit connected to the corresponding signal line and a second memory circuit connected to the corresponding pixel electrode, and either of two different potentials is supplied to the corresponding pixel electrode depending on a state of the second memory circuit;

a plurality of first switches, each connected between a corresponding first memory circuit and a corresponding signal line, which are selectively turned on by a selective signal from a corresponding scan line and which enable to write data on the corresponding signal line to the corresponding first memory circuit;

a plurality of second switches, each connected between a corresponding first memory circuit and a corresponding second memory circuit, which enable to transfer data from the corresponding first memory circuit to the corresponding second memory circuit when turned on;

at least one transfer control line for supplying a transfer signal which selectively turns the second switches on; and a transfer control line driver circuit for driving the transfer control line, wherein the driving method comprises the steps of:

turning the first switches on and writing data to the first memory circuits in a first period;

turning the second switches on and transferring data from the first memory circuits to a corresponding one of the second memory circuits in a second period, after writing data to each of the first memory circuits in the first period; and switching a potential of the counter electrode between a first potential and a second potential in the second period, wherein the second period comprises a fly-back period;

a potential of the counter electrode is switched per frame of an image signal;

a plurality of the pixel electrodes are allocated to each pixel and each of the pixel electrodes has a corresponding liquid crystal cell; and an area gray scale is used in the display device by changing a combination of liquid crystal cells which transmit light in each pixel.

37. A driving method of an active matrix display device according to any one of claims 33 to 36, wherein the signal lines are provided so as to be equal in number to the pixel electrodes included in one horizontal line;

a plurality of the first switches corresponding to a plurality of the pixel electrodes allocated to each pixel are connected to one of the signal lines; and a plurality of the first switches corresponding to a plurality of the pixel electrodes allocated to each pixel are connected to different scan lines, wherein the driving method comprises the steps of sequentially outputting to a corresponding signal line data for a plurality of the pixel electrodes allocated to each pixel, and turning on each of a plurality of the first switches allocated to each pixel by a signal from a corresponding scan line in synchronism with the data outputted to the signal lines.

38. A driving method of an active matrix display device, according to any one of claims 30, 31 and 33–36, wherein the active matrix display device comprises a plurality of transfer control lines, and the transfer control lines are divided into a plurality of groups; and the driving method comprises the step of supplying the transfer signal to each of the groups with different timing.

39. A driving method of an active matrix display device according to any one of claims 30, 31 and 33–36, wherein image display is performed in the first period in accordance with data written to the second memory circuit in the preceding second period.

* * * * *